US009050819B2

(12) United States Patent
Takekoshi et al.

(10) Patent No.: US 9,050,819 B2
(45) Date of Patent: Jun. 9, 2015

(54) IMAGE RECORDING APPARATUS, IMAGE RECORDING METHOD, IMAGE PROCESSING APPARATUS, AND STORAGE MEDIUM

(71) Applicant: Canon Kabushiki Kaisha, Tokyo (JP)

(72) Inventors: Rie Takekoshi, Kawasaki (JP); Takumi Kaneko, Tokyo (JP); Ayumi Hirakawa, Kawasaki (JP); Keita Ishimi, Yokohama (JP); Noboru Kunimine, Tokyo (JP); Yumi Kamimura, Inagi (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/315,192

(22) Filed: Jun. 25, 2014

(65) Prior Publication Data

US 2015/0002580 A1 Jan. 1, 2015

(30) Foreign Application Priority Data

Jun. 28, 2013 (JP) ..... 2013-136149

(51) Int. Cl.
*B41J 2/21* (2006.01)

(52) U.S. Cl.
CPC ..... *B41J 2/2107* (2013.01)

(58) Field of Classification Search
USPC ..... 347/43
See application file for complete search history.

(56) References Cited

U.S. PATENT DOCUMENTS

2009/0085960 A1* 4/2009 Yahiro et al. ..... 347/21
2011/0249055 A1* 10/2011 Sasada et al. ..... 347/20

FOREIGN PATENT DOCUMENTS

JP 2000-272220 A 10/2000

* cited by examiner

*Primary Examiner* — Jason Uhlenhake
(74) *Attorney, Agent, or Firm* — Canon USA Inc. IP Division

(57) ABSTRACT

When recording is performed using two different types of inks, the ink discharge order is controlled in a unit region on a recording medium so that the number of pixel regions in which an ink having a relatively high pH buffer capacity in a basic region is applied later is larger than the number of pixel regions in which an ink having a relatively low pH buffer capacity in a basic region is applied later.

24 Claims, 16 Drawing Sheets

IMAGE RECORDING APPARATUS, IMAGE RECORDING METHOD, IMAGE PROCESSING APPARATUS, AND STORAGE MEDIUM

BACKGROUND OF THE INVENTION

1. Field of the Invention

The present invention relates to an image recording apparatus, an image recording method, an image processing apparatus, and a storage medium.

2. Description of the Related Art

Image recording apparatuses with which an image is formed on a recording medium by repeatedly performing print scanning and sub scanning have been known. In the print scanning, ink is discharged while the recording medium is scanned with a recording head in which a plurality of discharge ports for discharging ink are arranged. In the sub scanning, the recording medium is conveyed. In such image recording apparatuses, a so-called multipass method in which print scanning is performed in a unit region of the recording medium multiple times is generally employed.

In recent years, various inks and recording media have been used in such image recording apparatuses. A combination of an ink containing a pigment and a recording medium having low ink permeability is known for the purpose of forming an image with high brightness.

However, it is known that, when an image is recorded using the above-described ink and recording medium, the scratch resistance degrades because the image is recorded by fixing the ink on a surface of the recording medium. Japanese Patent Laid-Open No. 2000-272220 discloses that the scratch resistance is improved by adding a polymer having reactivity with a reaction liquid to an ink and causing the reaction liquid to react with the polymer in the ink on a surface of the recording medium. Japanese Patent Laid-Open No. 2000-272220 also discloses that use of a polymer having a film forming property improves the scratch resistance because a polymer film is formed on a surface of the ink fixed on the recording medium through the reaction with the reaction liquid.

However, the technique disclosed in Japanese Patent Laid-Open No. 2000-272220 requires a mechanism for applying the reaction liquid onto the recording medium, in addition to a mechanism for applying the ink. This may increase the cost.

As a result of studies conducted by the inventors of the present invention, it has been found that, when an ink containing a pigment is used, the scratch resistance is sometimes not sufficiently achieved because of a mechanism that has not been assumed. It has also been found that such degradation of the scratch resistance because of the mechanism particularly occurs when, for example, an ink containing an anionic coloring material or a polymer is used. This problem will be described below in detail.

FIGS. 1A to 1C show a process for fixing ink droplets 50 formed when an ink containing a pigment is discharged onto a recording medium 3 having low ink permeability.

FIG. 1A shows the state of ink applied onto the surface of the recording medium 3. A pigment ink is fixed through vaporization of volatile components such as water contained in the ink. In particular, when an ink having an anionic group is used, an acid-precipitation reaction may occur in the ink droplets 50 that have been applied onto the recording medium 3. An acid-precipitation reaction is a reaction described below. When a pigment stably dispersed in ink due to electrostatic repulsion between acid dissociation anionic groups (e.g., —$COO^-$) of a polymer dispersant contacts an acid liquid composition or a recording medium, the acid dissociation anionic groups of the polymer dispersant are changed into non-dissociation anionic groups (e.g., —COOH) and the electrostatic repulsion is lost. As a result, the dispersion state of the pigment is disturbed and the pigment precipitates as an ink film 51.

FIG. 1B shows the state of ink on which an ink film 51 has been formed after the state in FIG. 1A. Since the ink film 51 is formed on each of the surfaces of the ink droplets 50 by the above-described acid-precipitation reaction, the vaporization of volatile components left in the ink droplets 50 is suppressed.

FIG. 1C shows the state of ink after the image recording has been completed. As a result of the acid-precipitation reaction, ink dots are stacked while volatile components are left in the ink droplets 50 even after the recording. Such a region in which the volatile components are left after the recording does not serve as an ink layer having sufficient fastness. If the region is rubbed with paper, cloth, or the like, the recorded image may be detached from the recording medium and the region may serve as a starting point of the detachment.

SUMMARY OF THE INVENTION

Aspects of the present invention may provide an image recording apparatus that can record an image having excellent scratch resistance even when an ink film is formed on each of surfaces of ink droplets by an acid-precipitation reaction in an image recording process, an image recording method, an image processing apparatus, and a storage medium.

According to an aspect of the present invention, an image recording apparatus includes a recording head configured to discharge at least a first-color ink containing a pigment and a second-color ink containing a pigment; a scanning unit configured to cause relative scanning between the recording head and a recording medium in a scanning direction, the recording medium having a unit region including a plurality of pixel regions each corresponding to each of a plurality of pixels; and a control unit configured to control discharge of the first-color ink and the second-color ink from the recording head onto the pixel regions while the scanning is caused by the scanning unit. The second-color ink has a higher pH buffer capacity in a basic region than the first-color ink. The control unit is configured to control the discharge of the first-color ink and the second-color ink so that in the unit region, among the pixel regions to which both the first-color ink and the second-color ink are applied, the number of pixel regions to which the second-color ink is applied after the first-color ink is applied is larger than the number of pixel regions to which the first-color ink is applied after the second-color ink is applied.

Further features of the present invention will become apparent from the following description of exemplary embodiments with reference to the attached drawings.

DESCRIPTION OF THE EMBODIMENTS

First Embodiment

A first embodiment of the present invention will be described below in detail with reference to the attached drawings.

Figure 2:
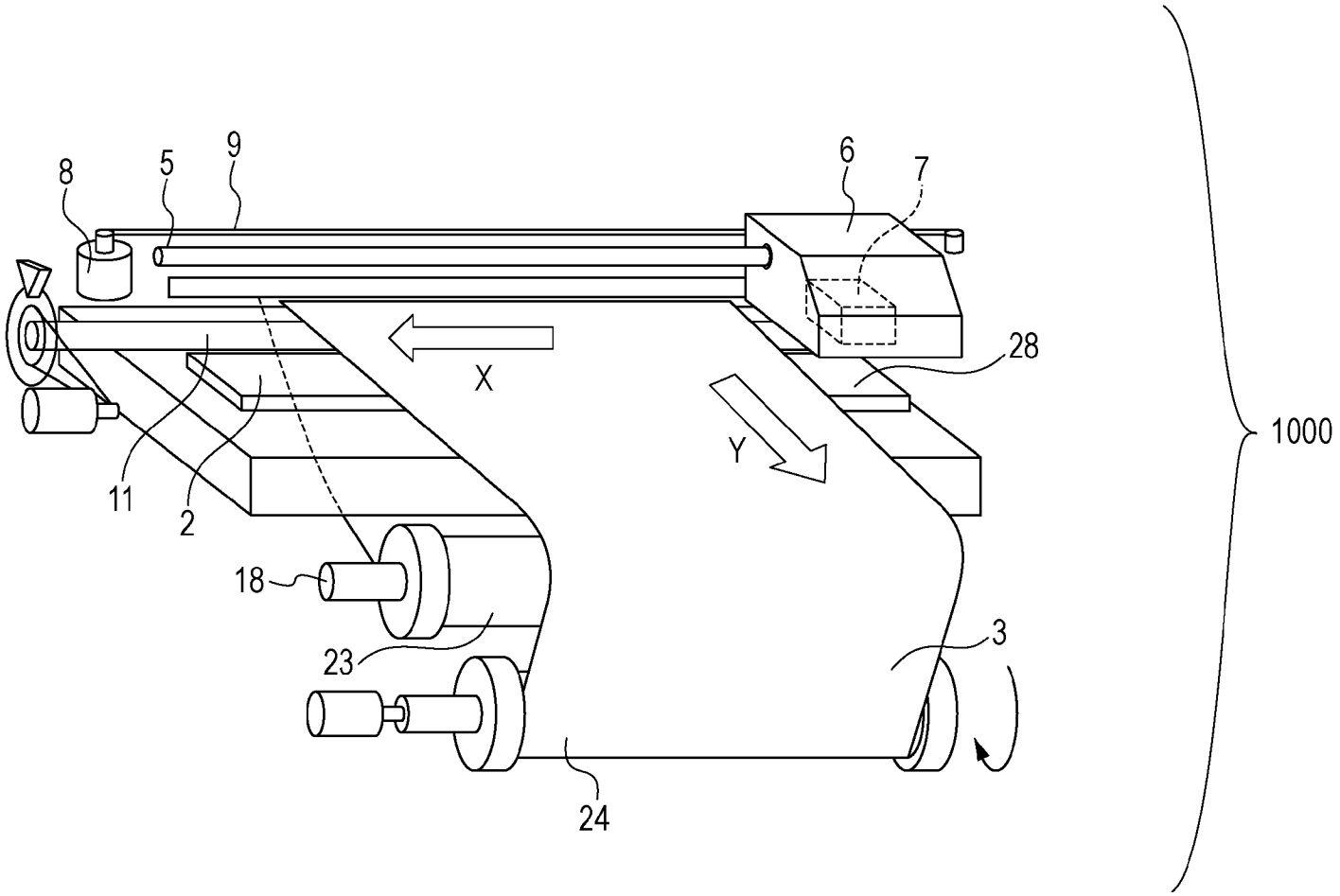
FIG. 2 is a perspective view showing an image recording apparatus applied in an embodiment.
Figure 3:
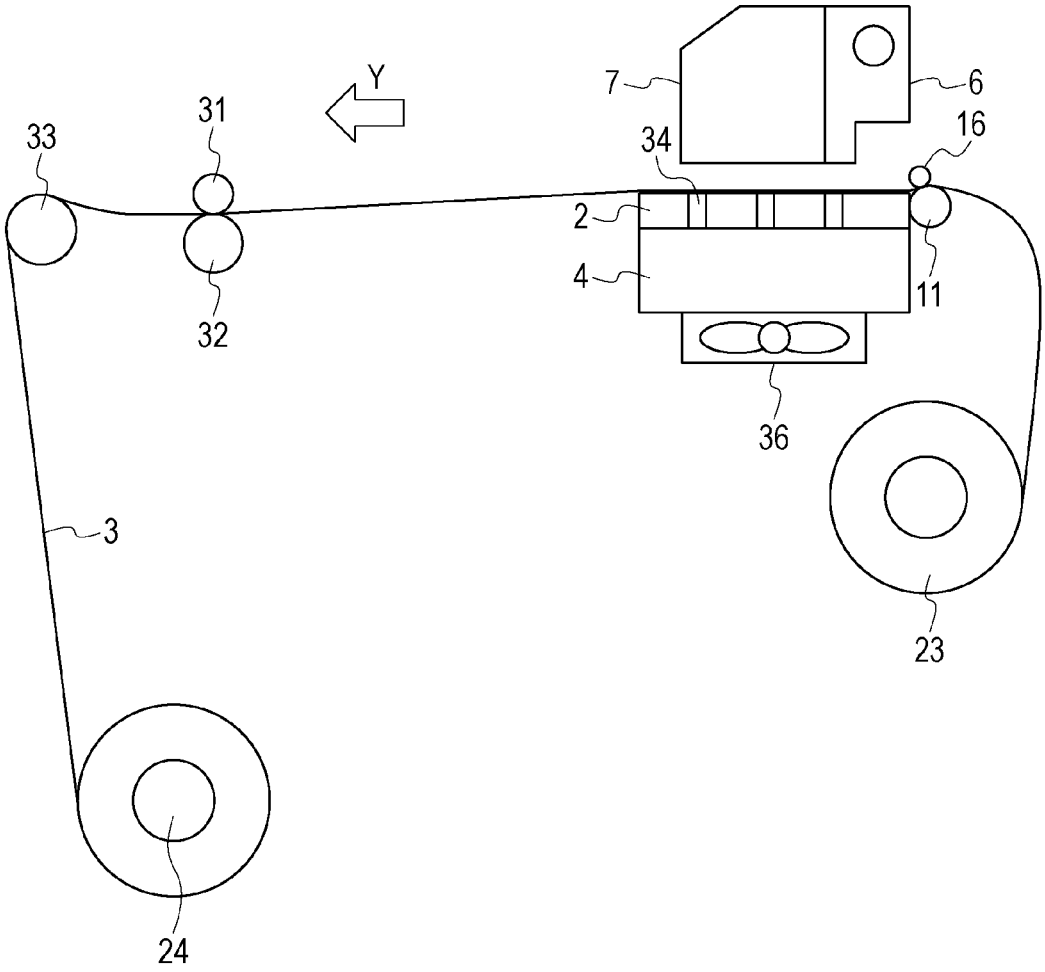
FIG. 3 is a side view showing the image recording apparatus applied in an embodiment.

FIG. 2 is a perspective view partially showing an internal structure of an image recording apparatus 1000 according to a first embodiment of the present invention. FIG. 3 is a side view partially showing an internal structure of the image recording apparatus 1000 according to a first embodiment of the present invention.

A platen 2 is disposed in the image recording apparatus 1000. Many suction holes 34 are formed in the platen 2 so that floating of a recording medium 3 is prevented by holding the recording medium 3 onto the platen 2. The suction holes 34 are connected to a duct 4, and a suction fan 36 is disposed below the duct 4. As a result of the operation of the suction fan 36, the recording medium 3 is held onto the platen 2.

A carriage 6 is supported by a main rail 5 disposed so as to extend in a paper-width direction and can reciprocate in an X direction. The carriage 6 includes an inkjet recording head 7 described below. The recording head 7 may employ various recording methods such as a thermal jet method that uses a heating element and a piezoelectric method that uses a piezoelectric element. A carriage motor 8 is a driving source for moving the carriage 6 in the X direction, and the rotational driving force is transferred to the carriage 6 through a belt 9.

The recording medium 3 is fed by being rolled out from a rolled medium 23. The recording medium 3 is conveyed in a Y direction (conveying direction) that intersects the X direction (scanning direction) on the platen 2. The leading edge of the recording medium 3 is sandwiched between a pinching roller 16 and a conveying roller 11. The recording medium 3 is conveyed by driving the conveying roller 11. The recording medium 3 is sandwiched between a roller 31 and an ejecting roller 32 in a downstream portion from the platen 2 in the Y direction. The recording medium 3 is rolled around a rolling roller 24 via a turn roller 33.

Figure 4:
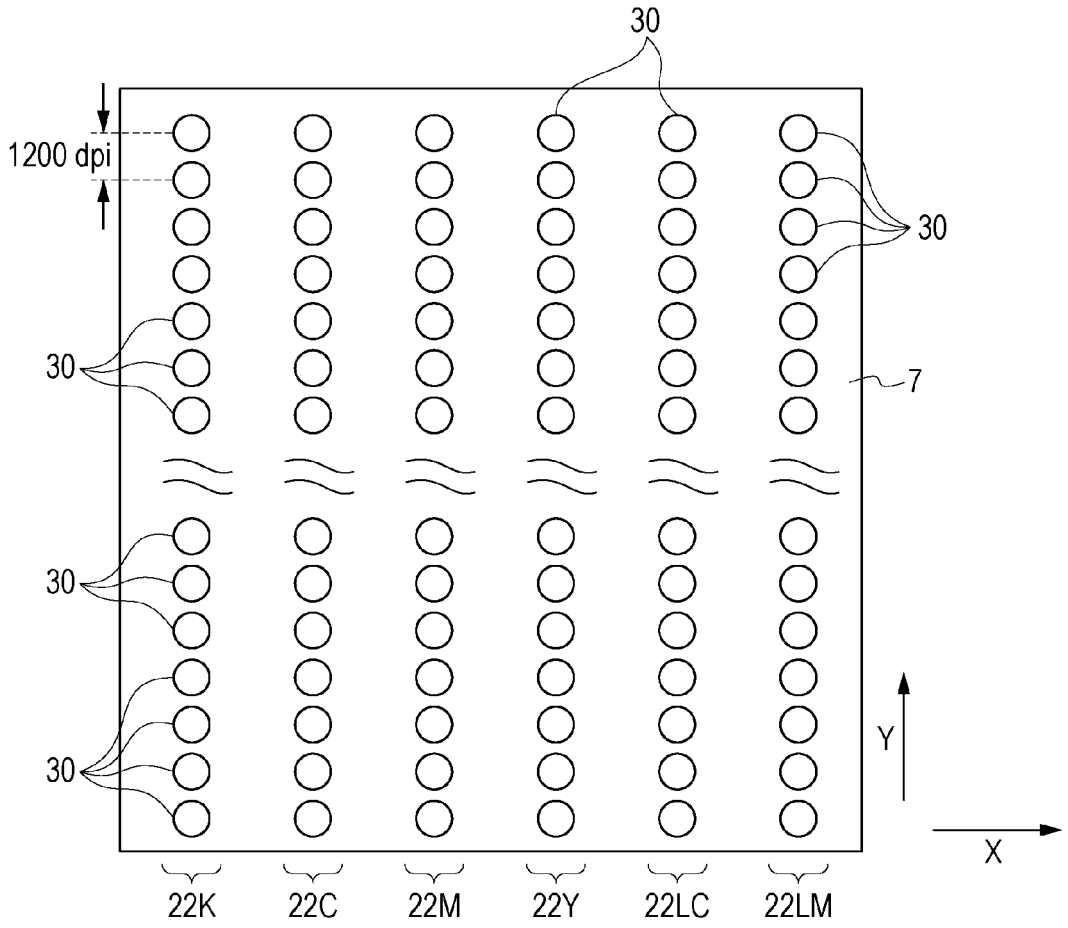
FIG. 4 is a schematic view showing a recording head applied in an embodiment.

FIG. 4 shows a recording head used in this embodiment.

In the recording head 7, six discharge port rows 22K, 22C, 22M, 22Y, 22LC, and 22LM that respectively discharge black (K) ink, cyan (C) ink, magenta (M) ink, yellow (Y) ink, light cyan (LC) ink, and light magenta (LM) ink are arranged in parallel in an X direction. In each of the discharge port rows 22K, 22C, 22M, 22Y, 22LC, and 22LM, 1280 discharge ports 30 for discharging ink are arranged in a Y direction at a density of 1200 dpi. In this embodiment, the amount of ink discharged each time from each of the discharge ports 30 is about 4.5 ng.

These discharge port rows 22K, 22C, 22M, 22Y, 22LC, and 22LM are connected to ink tanks (not shown) which store respective inks and from which the inks are supplied. The recording head 7 and the ink tanks used in this embodiment may be integrally provided or may be separately provided.

Ink Composition

The ink used in this embodiment will be described below in detail. Hereafter, "part" and "%" are expressed on a mass basis unless otherwise specified.

Preparation of Black Ink (1) Preparation of Dispersion Liquid

An anionic polymer P-1 (styrene/butyl acrylate/acrylic acid copolymer (polymerization ratio (weight ratio)=30/40/30) with an acid value of 202 and a weight-average molecular weight of 6500) was prepared. The anionic polymer P-1 was neutralized with an aqueous potassium hydroxide solution and diluted with ion exchanged water to prepare a homogeneous 10 mass % aqueous polymer solution.

After 600 g of the polymer solution, 100 g of carbon black, and 300 g of ion exchanged water were mixed and mechanically stirred for a predetermined time, non-dispersed matter containing coarse particles was removed by centrifugal separation to prepare a black dispersion liquid. The prepared black dispersion liquid had a pigment concentration of 10 mass %.

(2) Preparation of Ink

An ink is prepared by adding the following components to the black dispersion liquid so as to have a predetermined concentration. That is, these components were thoroughly mixed under stirring and then filtered under pressure with a microfilter (manufactured by Fujifilm Corporation) having a pore size of 2.5 μm to prepare a pigment ink having a pigment concentration of 5 mass %.

Black dispersion liquid: 50 parts
Zonyl FSO-100 (manufactured by Du Pont): 0.05 parts
Glycerol: 10 parts
Triethylene glycol: 10 parts
Acetylene glycol EO adduct (manufactured by Kawaken Fine Chemicals Co., Ltd.): 0.5 parts
Triethanolamine: 0.5 parts
Ion exchanged water: balance Preparation of Cyan Ink (1) Preparation of Dispersion Liquid An AB block copolymer with an acid value of 250 and a number-average molecular weight of 3000 was prepared by a common method using benzyl acrylate and methacrylic acid as raw materials. The AB block copolymer was neutralized with an aqueous potassium hydroxide solution and diluted with ion exchanged water to prepare a homogeneous 50 mass % aqueous polymer solution.

After 200 g of the polymer solution, 100 g of C.I. Pigment Blue 15:3, and 700 g of ion exchanged water were mixed and mechanically stirred for a predetermined time, non-dispersed matter containing coarse particles was removed by centrifugal separation to prepare a cyan dispersion liquid. The prepared cyan dispersion liquid had a pigment concentration of 10 mass %.

(2) Preparation of Ink

An ink is prepared by adding the following components to the cyan dispersion liquid so as to have a predetermined concentration. That is, these components were thoroughly mixed under stirring and then filtered under pressure with a microfilter (manufactured by Fujifilm Corporation) having a pore size of 2.5 μm to prepare a pigment ink having a pigment concentration of 2 mass %.

Cyan dispersion liquid: 20 parts
Zonyl FSO-100 (manufactured by Du Pont): 0.05 parts
Glycerol: 10 parts
Diethylene glycol: 10 parts
Acetylene glycol EO adduct (manufactured by Kawaken Fine Chemicals Co., Ltd.): 0.5 parts
Triethanolamine: 0.5 parts
Ion exchanged water: balance Preparation of Magenta Ink (1) Preparation of Dispersion Liquid An AB block copolymer with an acid value of 300 and a number-average molecular weight of 2500 was prepared by a common method using benzyl acrylate and methacrylic acid as raw materials. The AB block copolymer was neutralized with an aqueous potassium hydroxide solution and diluted with ion exchanged water to prepare a homogeneous 50 mass % aqueous polymer solution.

After 100 g of the polymer solution, 100 g of C.I. Pigment Red 122, and 800 g of ion exchanged water were mixed and mechanically stirred for a predetermined time, non-dispersed matter containing coarse particles was removed by centrifugal separation to prepare a magenta dispersion liquid. The prepared magenta dispersion liquid had a pigment concentration of 10 mass %.

(2) Preparation of Ink

An ink is prepared by adding the following components to the magenta dispersion liquid so as to have a predetermined concentration. That is, these components were thoroughly mixed under stirring and then filtered under pressure with a microfilter (manufactured by Fujifilm Corporation) having a pore size of 2.5 μm to prepare a pigment ink having a pigment concentration of 4 mass %.

Magenta dispersion liquid: 40 parts
Zonyl FSO-100 (manufactured by Du Pont): 0.05 parts
Glycerol: 10 parts
Diethylene glycol: 10 parts
Acetylene glycol EO adduct (manufactured by Kawaken Fine Chemicals Co., Ltd.): 0.5 parts
Triethanolamine: 0.5 parts
Ion exchanged water: balance Preparation of Yellow Ink (1) Preparation of Dispersion Liquid The anionic polymer P-1 was neutralized with an aqueous potassium hydroxide solution and diluted with ion exchanged water to prepare a homogeneous 10 mass % aqueous polymer solution.

After 300 g of the polymer solution, 100 g of C.I. Pigment Yellow 74, and 600 g of ion exchanged water were mixed and mechanically stirred for a predetermined time, non-dispersed matter containing coarse particles was removed by centrifugal separation to prepare a yellow dispersion liquid. The prepared yellow dispersion liquid had a pigment concentration of 10 mass %.

(2) Preparation of Ink

The following components were mixed and thoroughly stirred to achieve dissolution and dispersion. The resulting mixture was then filtered under pressure with a microfilter (manufactured by Fujifilm Corporation) having a pore size of 1.0 μm to prepare a pigment ink having a pigment concentration of 4 mass %.

Yellow dispersion liquid: 40 parts
Zonyl FSO-100 (manufactured by Du Pont): 0.025 parts
Glycerol: 9 parts
Ethylene glycol: 10 parts
Acetylene glycol EO adduct (manufactured by Kawaken Fine Chemicals Co., Ltd.): 1 part
Triethanolamine: 0.5 parts
Ion exchanged water: balance Preparation of Light Cyan Ink (1) Preparation of Dispersion Liquid A cyan dispersion liquid having a pigment concentration of 10 mass % was prepared by using the same raw materials and preparation method as in the description of the cyan ink.

(2) Preparation of Ink

An ink is prepared by adding the following components to the cyan dispersion liquid so as to have a predetermined concentration. That is, these components were thoroughly mixed under stirring and then filtered under pressure with a microfilter (manufactured by Fujifilm Corporation) having a pore size of 2.5 μm to prepare a pigment ink having a pigment concentration of 0.4 mass %.

Cyan dispersion liquid: 4 parts
Zonyl FSO-100 (manufactured by Du Pont): 0.025 parts
Glycerol: 10 parts
Diethylene glycol: 10 parts
Acetylene glycol EO adduct (manufactured by Kawaken Fine Chemicals Co., Ltd.): 0.5 parts
Triethanolamine: 1.0 part
Ion exchanged water: balance Preparation of Light Magenta Ink (1) Preparation of Dispersion Liquid A magenta dispersion liquid having a pigment concentration of 10 mass % was prepared by using the same raw materials and preparation method as in the description of the magenta ink.

(2) Preparation of Ink

An ink is prepared by adding the following components to the magenta dispersion liquid so as to have a predetermined concentration. That is, these components were thoroughly mixed under stirring and then filtered under pressure with a microfilter (manufactured by Fujifilm Corporation) having a pore size of 2.5 μm to prepare a pigment ink having a pigment concentration of 0.8 mass %.

Magenta dispersion liquid: 8 parts
Zonyl FSO-100 (manufactured by Du Pont): 0.025 parts
Glycerol: 10 parts
Diethylene glycol: 10 parts
Acetylene glycol EO adduct (manufactured by Kawaken Fine Chemicals Co., Ltd.): 0.5 parts
Triethanolamine: 1.0 part
Ion exchanged water: balance Each of the inks used in this embodiment contains weakly basic triethanolamine. The triethanolamine is contained for the purpose of, for example, pH adjustment, prevention of oxidation, and suppression of beading.

However, the viscosity of ink increases as the content of triethanolamine in the ink increases, which poses a problem such as a discharge defect of ink from discharge ports. In this embodiment, an appropriate amount of triethanolamine is added to each of the inks in order to, for example, suppress beading without causing a discharge defect of ink. Specifically, 0.5 mass % of triethanolamine is added to the cyan ink, magenta ink, yellow ink, and black ink and 1.0 mass % of triethanolamine is added to the light cyan ink and light magenta ink. By differentiating the amounts of triethanolamine, which is a weakly basic substance, added to the inks to achieve the image quality and discharge reliability, the pH buffer capacity in a basic region described below is changed.

Since the inks of this embodiment are composed of an anionic coloring material, the pH of the inks is stable on the basic side and is 8.5 or more and 9.5 or less. The pH of ink can be generally 7.0 or more and 10.0 or less for the purpose of preventing the degradation of a material constituting a member that contacts the ink and the decrease in the solubility of a pigment and a dispersion polymer in the ink. The pH is measured with a pH meter model F-52 manufactured by HORIBA, Ltd. The pH meter is not limited to the above example as long as the pH of ink can be measured.

The buffer capacity in a basic region of the inks used in this embodiment will be described below in detail.

The pH buffer capacity of ink in a basic region is an index corresponding to a variation in hydrogen ion concentration caused when an acid is added to an ink having a pH of 7 or more. More specifically, the larger the variation in hydrogen ion concentration caused when an acid is added to an ink having a pH of 7 or more becomes, the lower the pH buffer capacity in a basic region is. The smaller the variation in hydrogen ion concentration becomes, the higher the pH buffer capacity in a basic region is. In other words, an ink having a higher pH buffer capacity in a basic region has a larger number of hydroxide ions. Furthermore, if an ink having a low pH (e.g., pH of 8.5 or more and 9.5 or less) has a high pH buffer capacity in a basic region, the pH does not readily decrease even when an acid is added.

In this embodiment, triethanolamine (chemical formula: $(C_2H_5)_3N$) causes a reaction represented by formula (1) below in the ink.

$$(C_2H_5)_3N+H_2O \rightarrow (C_2H_5)_3NH^+ + OH^- \quad \text{Formula (1)}$$

As is clear from formula (1), even if an acid ($H^+$) is added to an ink containing triethanolamine, the acid is neutralized with $OH^-$ on the right side of formula (1) to form $H_2O$, and thus the change in pH of the ink is suppressed. As described above, the pH of the inks used in this embodiment is 8.5 or more and 9.5 or less. This makes it clear that the triethanolamine used in this embodiment has a pH buffer capacity in a basic region. Furthermore, the buffer action in formula (1) becomes strong as the content of triethanolamine increases. This makes it clear that the light cyan ink and light magenta ink used in this embodiment have a higher pH buffer capacity than the cyan ink, magenta ink, yellow ink, and black ink.

The pH buffer capacity in a basic region of the inks used in this embodiment can be experimentally calculated. The experimental method and results will be described below in detail.

Figure 5:
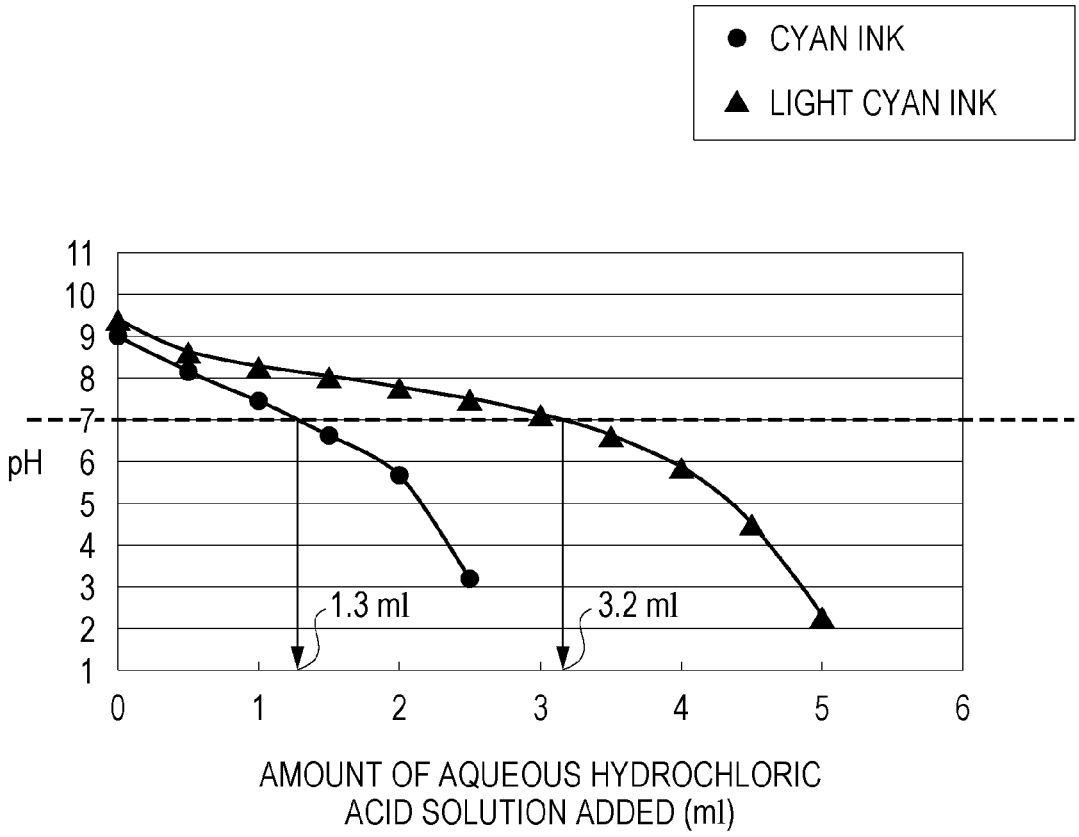
FIG. 5 is a graph for describing the pH buffer capacity of inks used in an embodiment.

Specifically, a 1 N aqueous hydrochloric acid solution was added dropwise in an amount of 0.5 ml per drop to 50 ml of each of the inks used in this embodiment using a dropping syringe while the ink was being stirred. About 10 seconds after the dropwise addition, the pH of the ink was measured with a pH meter. The dropwise addition of the aqueous hydrochloric acid solution and the measurement of pH were alternately performed in a repeated manner to calculate the amount of the aqueous hydrochloric acid solution added dropwise until the pH reached 7. Note that "1 N" is a concentration in which one gram equivalent of a solute is contained in 1 $dm^3$ of a solution. FIG. 5 shows the experimental results.

As described above, the inks used in this embodiment have substantially the same pH value of 8.5 or more and 9.5 or less. Therefore, the pH buffer capacity in a basic region can be determined by the amount of the aqueous hydrochloric acid solution added dropwise until the pH of the ink reaches 7. In other words, it is believed that the larger the amount of the aqueous hydrochloric acid solution added dropwise until the pH of the ink reaches 7 becomes, the higher the pH buffer capacity in a basic region is.

For example, the amount of the aqueous hydrochloric acid solution required until the pH of the cyan ink used in this embodiment reaches 7 is about 1.3 ml. The amount of the aqueous hydrochloric acid solution required until the pH of the light cyan ink used in this embodiment reaches 7 is about 3.2 ml. This makes it clear that the light cyan ink has a higher buffer capacity than the cyan ink.

Table 1 shows the amount of the aqueous hydrochloric acid solution required until the pH of each of the inks used in this embodiment reaches 7, the amount being measured in the same manner as in the cases of the cyan ink and the light cyan ink.

TABLE 1

| Ink | Amount of 1N aqueous hydrochloric acid solution added (ml) |
|---|---|
| Cyan ink | 1.3 |
| Magenta ink | 1.3 |
| Yellow ink | 1.4 |
| Black ink | 1.5 |
| Light cyan ink | 3.2 |
| Light magenta ink | 3.1 |

It is understood from Table 1 that the amounts of the aqueous hydrochloric acid solution required until the pH of the light cyan ink and light magenta ink reaches 7 are relatively larger than those of other inks. Therefore, it can be experimentally confirmed that the pH buffer capacity in a basic region of the light cyan ink and light magenta ink having a high content of triethanolamine is relatively high.

In this embodiment, the change in pH caused when 1 ml of a 1 N aqueous hydrochloric acid solution is added to 50 ml of the inks having a relatively high pH buffer capacity is preferably 1.5 or less and more preferably 1.0 or less.

In the case where an ink having low permeability or no permeability to a recording medium is used, if the surface tension of a liquid phase of the ink is high, the ink that has impacted the surface of the recording medium is fixed as a result of aggregation without spreading. Consequently, the image quality degrades. In particular, when an ink having a surface tension of more than 30 mN/m is used for a recording medium having low ink permeability, the image quality considerably degrades. Therefore, the surface tension of each of the inks can be 30 mN/m or less. The surface tensions of the inks can be close to each other so that the inks have substantially the same discharge characteristics such as discharge amounts and discharge speeds and substantially the same permeability on the surface of the recording medium. For this reason, the surface tension of each of the inks used in this embodiment is adjusted to 25 mN/m to 26 mN/m in the same temperature environment.

The surface tension in a liquid phase of each of the inks in this embodiment was measured with Bubble Pressure Tensiometer (trade name) manufactured by KRÜSS GmbH. Various instruments in addition to the above instrument can be used as long as the surface tension in a liquid phase of ink can be measured.

The recording medium used in this embodiment will be described below in detail.

As described above, an ink layer is easily formed on the surface of the recording medium as the ink permeability of the recording medium decreases. Therefore, when a recording medium having low ink permeability is used, significant effects are produced in an embodiment described below.

An example of the recording medium having low ink permeability is coated paper obtained by coating a surface of plain paper with a white pigment or the like.

In this embodiment, OK Top Coat+(manufactured by Oji Paper Co., Ltd., basis weight: 157.0 g/m$^2$), which is one type of the coated paper, is used as the recording medium 3.

In this embodiment, various methods can be employed to evaluate the ink permeability of recording media. One of the methods is a Bristow test described in "Liquid absorption testing method for paper and paperboard" of Japan Technical Association of the Pulp and Paper Industry (JAPAN TAPPI) Test Method No. 51. The evaluation of the ink permeability of the recording medium will be described below.

A predetermined amount of ink is inserted into a holding container including an opening slit with a predetermined size. The holding container is brought into contact with a recording medium with the slit located therebetween, the recording medium being processed into a strip and wound around a wheel. The wheel is rotated while the position of the holding container is fixed. The area (length) of a streak of the ink transferred onto the recording medium is measured. A transferred ink amount per unit area (ml·m$^{-2}$) per second can be calculated from the area of the streak of the ink.

The transferred ink amount for typical printing coated paper was measured by the Bristow test. The transferred ink amount per second was 20 ml·m$^{-2}$ or less. In particular, the transferred ink amount for OK Top Coat+was slightly smaller than 10 ml·m$^{-2}$. In this embodiment, recording can also be performed on recording media having low ink permeability, such as printing coated paper.

On the other hand, the transferred ink amount per second for plain paper, which is measured by the Bristow test, is usually 30 ml·m$^{-2}$ or more, and plain paper generally has high ink permeability. However, the transferred ink amount for some types of plain paper, which is measured by the Bristow test, is less than 20 ml·m$^{-2}$. Although such recording media are plain paper, they are regarded as recording media having low ink permeability. In this embodiment, such recording media having low ink permeability can also be used in addition to printing coated paper. Furthermore, recording media made of cloth or leather and having low ink permeability can also be used. In this embodiment, recording media having no ink permeability, such as polyethylene sheets, can also be used.

In this embodiment, an image is formed by a multipass recording method. The multipass recording method will be described below in detail.

Figure 6:
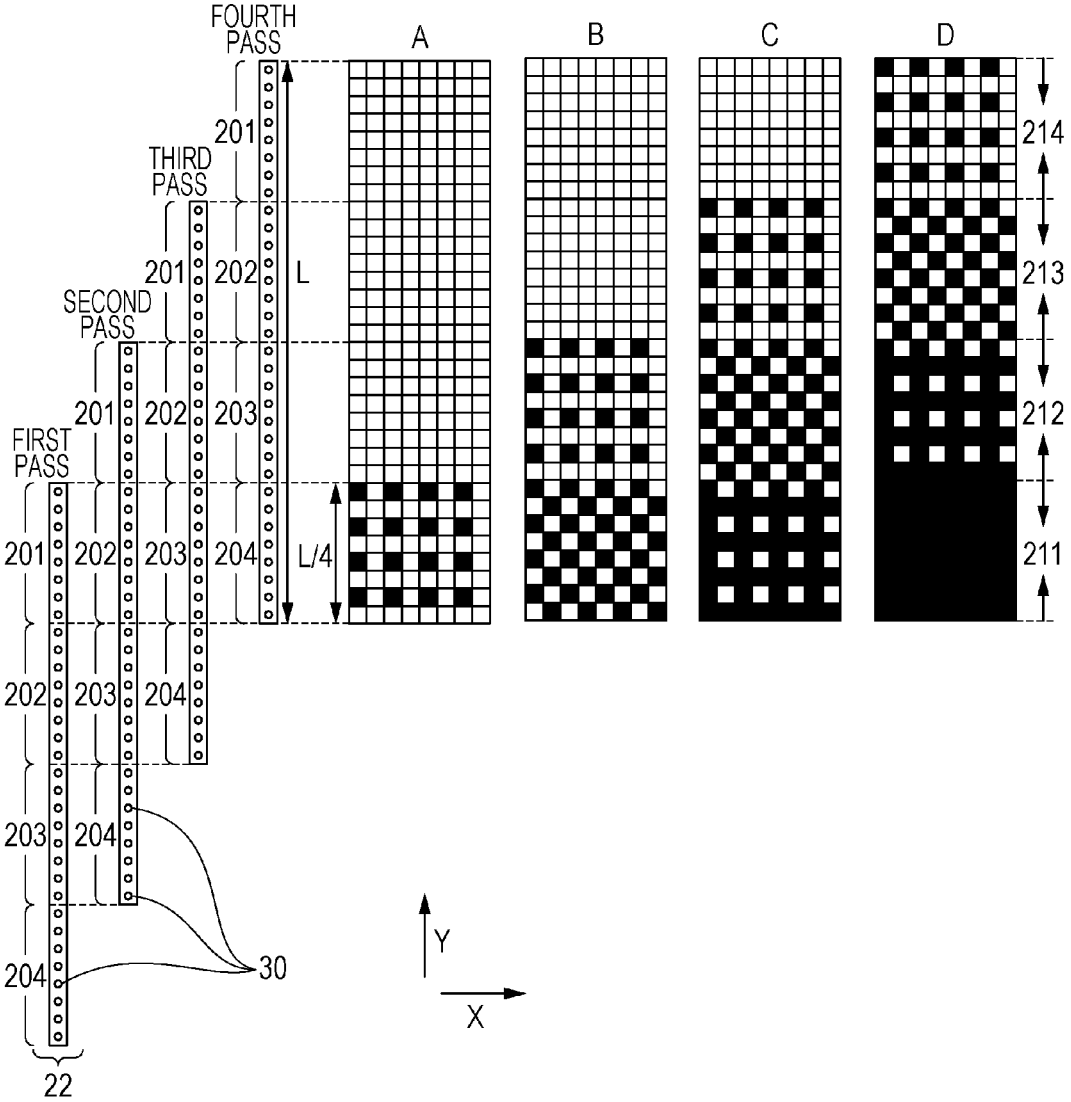
FIG. 6 is a diagram for describing a typical multipass recording method.
Figure 7A:
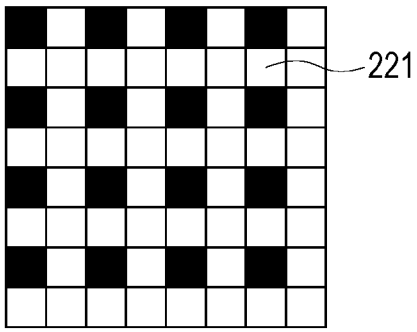
FIGS. 7A to 7D are schematic views showing mask patterns applied in a typical multipass recording method.
Figure 7B:
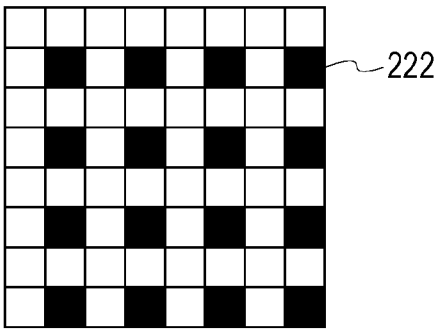
Figure 7C:
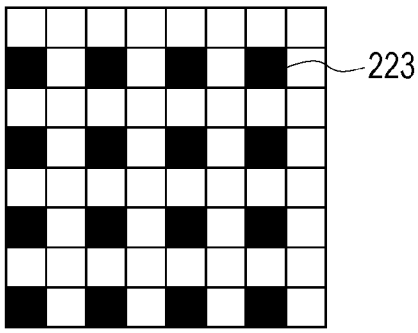
Figure 7D:
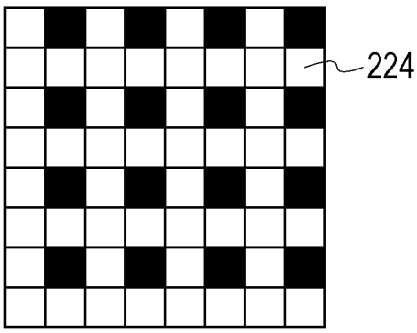

FIG. 6 shows a multipass recording method used when recording is performed in a unit region on a recording medium by four print scanning operations.

FIGS. 7A to 7D are diagrams for describing mask patterns applied to print scanning operations in the multipass recording method.

Discharge ports 30 disposed on a discharge port row 22 for discharging ink are divided into four recording groups 201, 202, 203, and 204 in a sub-scanning direction.

Each of mask patterns 221, 222, 223, and 224 is constituted by arranging a plurality of print permitted pixels where ink is discharged and a plurality of print forbidden pixels where ink is not discharged. In FIGS. 7A to 7D, black-solid portions indicate the print permitted pixels and white-solid portions indicate the print forbidden pixels. In the print permitted pixels, when image data that indicates ink discharge is input, the image data is converted into recording data for actually discharging ink. In the print forbidden pixels, even when image data that indicates ink discharge is input, the image data is converted into recording data for not discharging ink.

The print permitted pixels in the mask patterns 221, 222, 223, and 224 are arranged in different positions so that the logical sum of the print permitted pixels corresponds to all pixels.

An example of forming an image with a duty of 100% (hereafter also referred to as "a solid image") on a recording medium will be described below.

In a first print scanning operation, an ink is discharged onto a region 211 on the recording medium 3 from the recording group 201 on the basis of the mask pattern 221. As a result, the ink is discharged on the recording medium at a position indicated by A in FIG. 6.

Subsequently, the recording medium 3 is conveyed with respect to the recording head 7 by a distance of L/4 in a Y direction from the upstream side to the downstream side.

A second print scanning operation is then performed. In the second print scanning operation, an ink is discharged onto the region 211 on the recording medium from the recording group 202 on the basis of the mask pattern 222 and an ink is discharged onto a region 212 on the recording medium from the recording group 201 on the basis of the mask pattern 221. As a result of the second print scanning operation, an image indicated by B in FIG. 6 is formed on the recording medium 3.

Hereafter, the print scanning operation of the recording head 7 and the relative conveyance of the recording medium 3 are sequentially performed in a repeated manner. Consequently, after a fourth print scanning operation is completed, an ink is discharged onto pixel regions corresponding to all pixels in the region 211 of the recording medium 3 as indicated by D in FIG. 6, and thus a solid image is formed.

In the description below, pixel regions corresponding to pixels on the recording medium are also simply referred to as "pixel regions".

Figure 8:
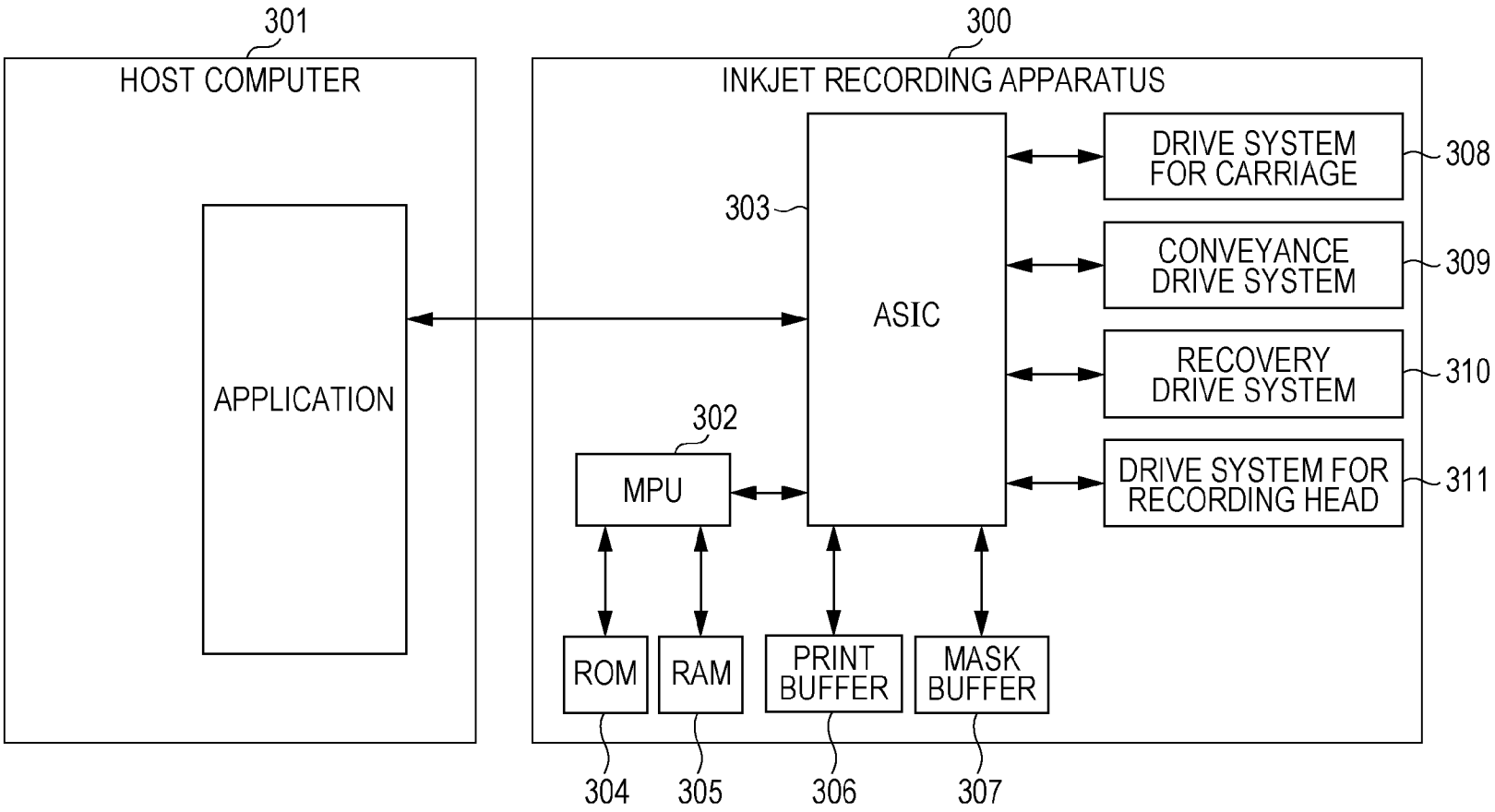
FIG. 8 is a block diagram showing the configuration of a recording control system in an embodiment.

FIG. 8 is a block diagram schematically showing the configuration of a recording control system according to this embodiment.

A host computer 301 serving as an image input unit transmits RGB multivalued image data stored in a storage medium such as a hard disk to an image processing unit in an image recording apparatus 300.

The image processing unit includes a micro-processor unit (MPU) 302 described below and an application-specific integrated circuit (ASIC) 303. The multivalued image data can also be received from external image input devices such as a scanner and a digital camera connected to the host computer 301. The image processing unit performs image processing described below so as to convert the input multivalued image data into binary image data. This generates binary image data which is recording data for discharging multiple types of inks from the recording head 7.

The image recording apparatus 300 serving as an image output unit records an image by applying an ink to the recording medium 3 in accordance with the ink binary image data generated by the image processing unit. The image recording apparatus 300 is controlled by the MPU 302 in accordance with a program recorded on a read-only memory (ROM) 304. A random-access memory (RAM) 305 is used as a work area of the MPU 302 or a temporary data storage area. The MPU 302 controls a drive system 308 for a carriage 6, a conveyance drive system 309 for the recording medium 3, a recovery drive system 310 for the recording head 7, and a drive system 311 for the recording head 7 via the ASIC 303.

The print buffer 306 temporarily holds recording data that has been converted into a format that can be transferred to the recording head 7.

A mask buffer 307 temporarily holds mask patterns applied when the recording data is transferred to the recording head 7. A plurality of mask patterns used for the multipass recording are prepared in the ROM 304. A desired mask pattern is read from the ROM 304 during actual recording, and is stored in the mask buffer 307.

In this embodiment, it has been described that the image processing unit is included in the image recording apparatus 300, but the image processing unit may be included in the host computer 301.

Characteristic Feature

In this embodiment, the scratch resistance is improved by controlling the order of ink discharge so that an ink having a relatively low pH buffer capacity in a basic region and an ink having a relatively high pH buffer capacity in a basic region are applied to the recording medium in that order.

The assumed mechanism with which the scratch resistance is improved by applying an ink having a low pH buffer capacity prior to an ink having a high pH buffer capacity will be described below in detail.

For ease of understanding, a cyan ink is referred to as the ink having a low pH buffer capacity in a basic region and a light cyan ink is referred to as the ink having a high pH buffer capacity in a basic region.

Figure 9A:
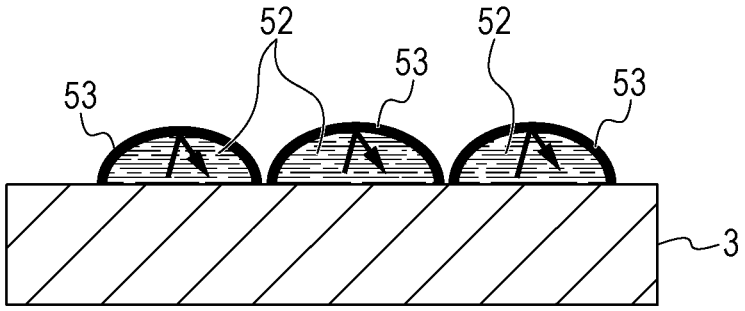
FIGS. 9A to 9C are diagrams for describing mechanisms of a pH buffer capacity and the redissolution of an ink film.
Figure 9B:
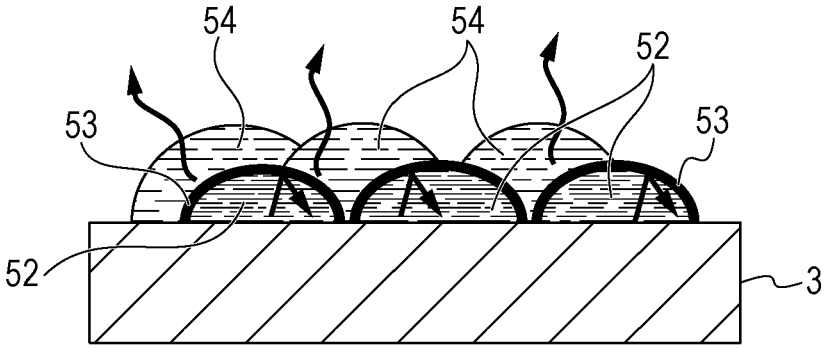
Figure 9C:
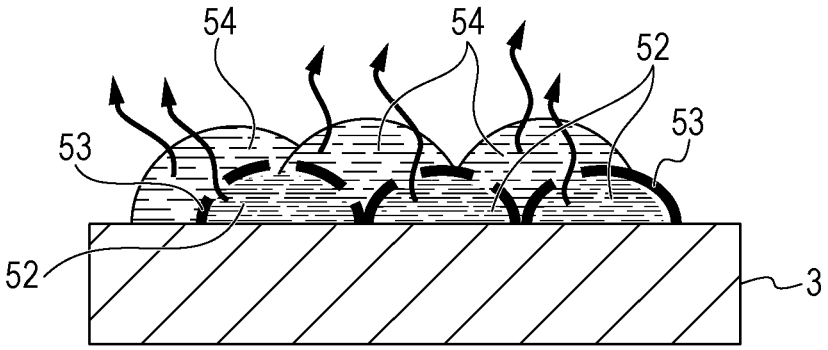

FIGS. 9A to 9C are diagrams for describing an ink fixation process performed when a cyan ink and a light cyan ink are applied onto a recording medium in that order.

FIG. 9A shows a state of a cyan ink applied onto a recording medium. In this embodiment, the pH of a paper surface of the recording medium is lower than that of the cyan ink. Therefore, an acid-precipitation reaction occurs when the cyan ink is applied onto the recording medium. Consequently, an ink film 53 composed of a dispersion polymer is formed on a surface of each of cyan ink droplets 52. The presence of the ink film 53 suppresses the vaporization of volatile components contained in the ink droplets 52, which causes insufficient drying.

FIG. 9B shows a state immediately after a light cyan ink is applied in a region where the cyan ink has been applied onto the recording medium. Immediately after the application of the light cyan ink, an $OH^-$ group that naturally dissociates in the light cyan ink acts on the ink film 53 formed on the cyan ink by the acid-precipitation reaction near the contact portion between the ink film 53 of the cyan ink and the ink droplets 54 of the light cyan ink. This partially causes a redissolution reaction on the ink film 53. Furthermore, since the light cyan ink has a high pH buffer capacity in a basic region, the light cyan ink has a characteristic of supplying again an $OH^-$ group consumed by the redissolution reaction. It is believed that the light cyan ink contains a large amount of $OH^-$ group that can be supplied, which effectively causes the redissolution reaction on the ink film 53.

FIG. 9C shows a state after the redissolution reaction of the ink film is caused to proceed by applying the light cyan ink. When the redissolution reaction of the ink film 53 proceeds to some extent, voids are formed in the ink film 53, which allows the volatile components contained in the ink droplets 52 of the cyan ink to volatilize through the voids. Consequently, the amount of volatile components left in an ink layer is decreased and an image is formed of an ink layer constituted by sufficiently dried ink droplets. Thus, the scratch resistance is believed to be improved.

Figure 10:
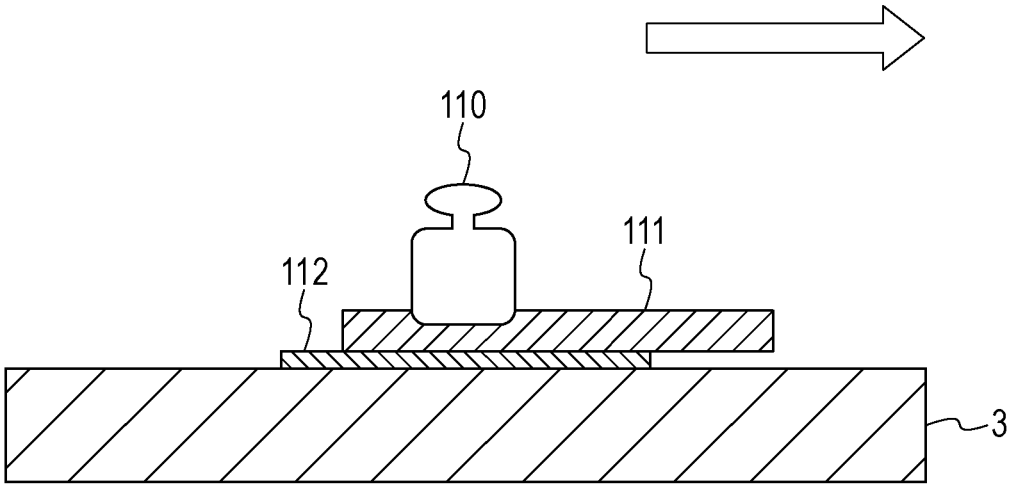
FIG. 10 is a diagram for describing an evaluation experiment for scratch resistance.

A method for investigating an improvement in scratch resistance by controlling the discharge order will be described below in detail. FIG. 10 shows a test method for evaluating scratch resistance. Herein, the scratch resistance is evaluated by a method described in ISO 12647-7 Appendix A.

A recording medium 3 on which a two-centimeter-square solid image 112 is recorded by performing scanning eight times in total is placed on a flat place. Four silbon paper sheets ("Cleaning Wiper Dusper" manufactured by OZU CORPORATION TOKYO) 111 are placed on an image surface so as to be stacked on top of each other. A weight 110 (160 g/cm$^2$) is placed thereon. The silbon paper sheets 111 are caused to slide at a constant speed (about 15 cm/s) in a direction indicated by an arrow in FIG. 10 so that the weight 110 does not fall down. The above process is conducted one minute and three minutes after the completion of the recording of the solid image 112. The degree of disturbance of the surface of the solid image 112 on the recording medium 3 and the degree of retransfer onto the silbon paper sheets 111 are evaluated. The evaluation scores and evaluation criteria for fixability after the image formation are described below.

Five Points

There is almost no change in an image-formed region. There is also almost no trace of a coloring material in a region (hereafter referred to as "a paper margin") in which an image is not formed on the recording medium. Almost no coloring material is transferred onto the silbon paper.

Four Points

After the test, a trace of scraping is slightly observed in an image-formed region. In the paper margin, several lines having a length of 5 mm or less and formed by the dragged coloring material are observed in a direction in which the silbon paper is slid from the boundary between the image-formed region and the paper margin to the paper margin. The degree of the transfer of the coloring material onto the silbon paper is very small, but the transferred coloring material is found by thorough observation.

Three Points

After the test, a trace of scraping is observed in an image-formed region. In the paper margin, several lines having a length of 5 mm or more and formed by the dragged coloring material are observed in a direction in which the silbon paper is slid from the boundary between the image-formed region and the paper margin to the paper margin. The coloring material is found to be transferred onto the silbon paper, but the degree of transfer is smaller than that in the image-formed region.

Two Points

After the test, a trace of scraping is clearly observed in an image-formed region. In the paper margin, many lines having a length of 5 mm or more and formed by the dragged coloring material are observed in a direction in which the silbon paper is slid from the boundary between the image-formed region and the paper margin to the paper margin, but the boundary between the image-formed region and the paper margin can be recognized. The coloring material is transferred onto the silbon paper in an amount substantially equal to the amount of a coloring material left in the image-formed region after the sliding of the silbon paper.

One Point

After the test, the image-formed region is scraped and the background color (surface) of the recording medium is observed. In the paper margin, many lines having a length of 5 mm or more are observed to the degree that the boundary becomes unclear in a direction in which the silbon paper is slid from the boundary between the image-formed region and the paper margin to the paper margin. The coloring material is transferred onto the silbon paper in an amount larger than the amount of a coloring material left in the image-formed region after the sliding of the silbon paper in some places.

Table 2 shows the results of the above scratch resistance evaluation test performed on an image recorded by discharging a cyan ink and a light cyan ink in that order and an image recorded by discharging a light cyan ink and a cyan ink in that order.

In each of the images, an image formed of a cyan ink with a duty of 50% and a light cyan ink with a duty of 50% is used as a solid image for evaluation.

TABLE 2

| Discharge order | Evaluation score | |
|---|---|---|
| | After one minute | After three minutes |
| Recorded in the order of cyan ink and light cyan ink | 5 | 5 |
| Recorded in the order of light cyan ink and cyan ink | 3 | 3 |

As is clear from Table 2, when recording was performed in the order of a light cyan ink having a high pH buffer capacity in a basic region and a cyan ink having a low pH buffer capacity in a basic region, the evaluation score was three points one minute after the completion of the recording and was also three points three minutes after the completion of the recording in terms of scratch resistance of the recorded image.

When recording was performed in the order of a cyan ink having a low pH buffer capacity in a basic region and a light cyan ink having a high pH buffer capacity in a basic region, the evaluation score was five points even one minute after the completion of the recording. This means that the scratch resistance of the recorded image is improved.

It can be experimentally demonstrated from the results that it is effective to control the discharge order so that an ink having a relatively low pH buffer capacity in a basic region and an ink having a relatively high pH buffer capacity in a basic region are discharged in that order.

In view of the foregoing, in this embodiment, the discharge of at least a cyan ink and a light cyan ink among a plurality of inks is controlled so that the cyan ink and the light cyan ink are discharged in that order onto the entire region on the recording medium.

Figure 11:
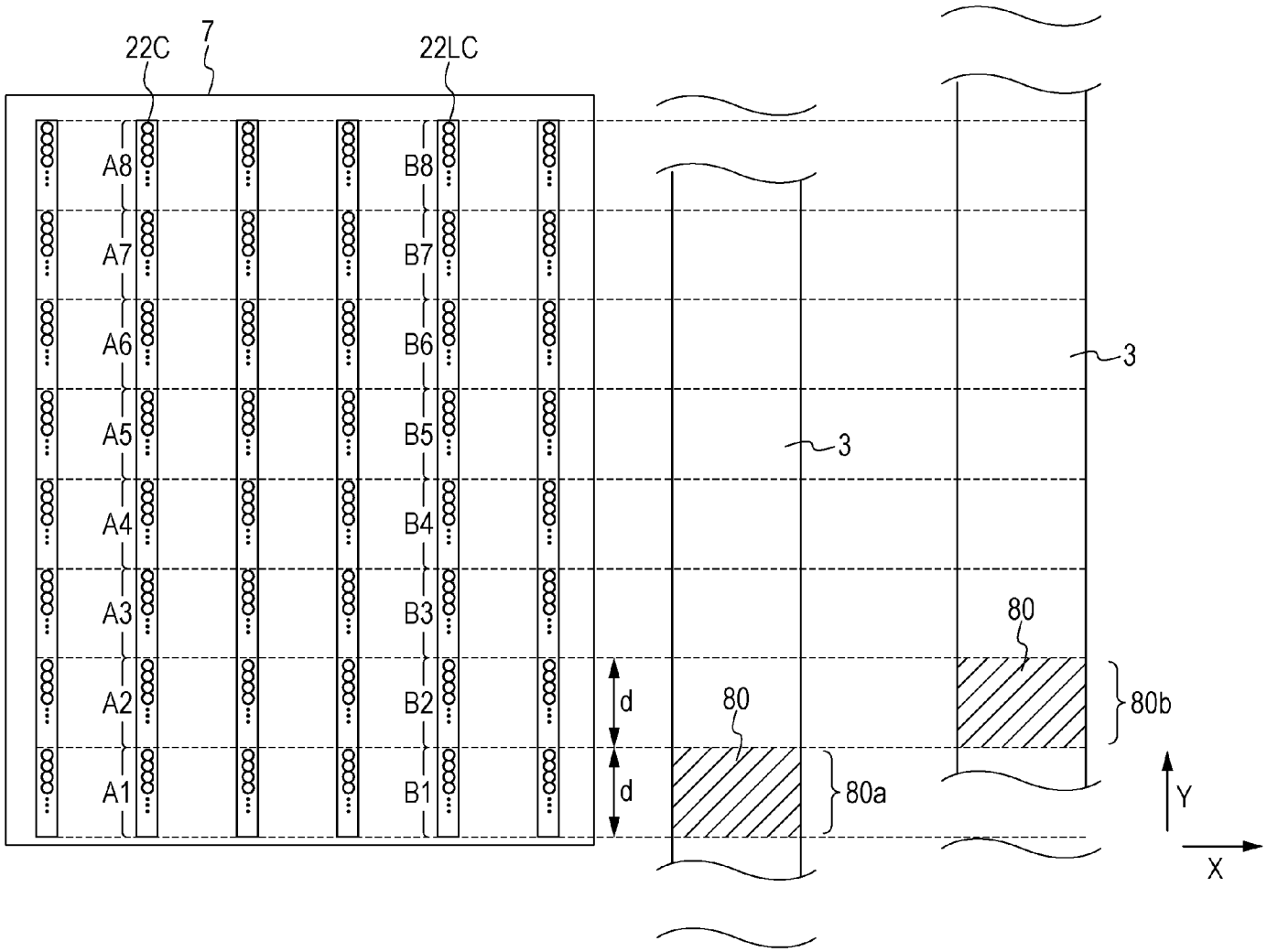
FIG. 11 is a diagram for describing a multipass recording method applied in an embodiment.

FIG. 11 is a diagram for describing a multipass recording method in this embodiment.

In this embodiment, a method is employed in which an image is completely formed in a unit region 80 on a recording medium by performing eight print scanning operation. In a recording head 7 used in this embodiment, 1280 discharge ports arranged in a discharge port row 22C for discharging a cyan ink are divided into eight recording groups A1 to A8 and 1280 discharge ports arranged in a discharge port row 22LC for discharging a light cyan ink are divided into eight recording groups B1 to B8. Each of the recording groups A1 to A8 and B1 to B8 has a length d. Herein, each recording group includes 160 discharge ports.

The length of the unit region 80 on the recording medium 3 in a Y direction corresponds to a single relative moving distance between the recording head 7 and the recording medium 3 in the Y direction and also corresponds to the length d of each recording group in the discharge port rows 22C and 22LC. The length of the unit region 80 in the X direction corresponds to the length of the recording medium 3 in the X direction.

When the unit region 80 of the recording medium 3 is located at a position 80*a*, inks are discharged onto the unit region 80 from discharge ports that belong to the recording group A1 of the discharge port row 22C and the recording group B1 of the discharge port row 22LC in accordance with mask patterns described below while the recording head 7 is caused to scan in the X direction. Subsequently, the recording medium 3 is conveyed in the Y direction by a distance corresponding to the length d, and thus the unit region 80 is moved to a position 80*b*. After this conveyance, inks are discharged from discharge ports that belong to the recording group A2 of the discharge port row 22C and the recording group B2 of the discharge port row 22LC onto the unit region 80 on the recording medium 3 where inks have been discharged from the discharge ports that belong to the recording groups A1 and B1 while the recording head 7 is caused to scan in the X direction. After this, an image is formed by scanning the unit region 80 on the recording medium 3 with the recording head 7 eight times in total while conveying the recording medium 3 by a distance corresponding to the length d between the scanning operations.

Figure 12A:
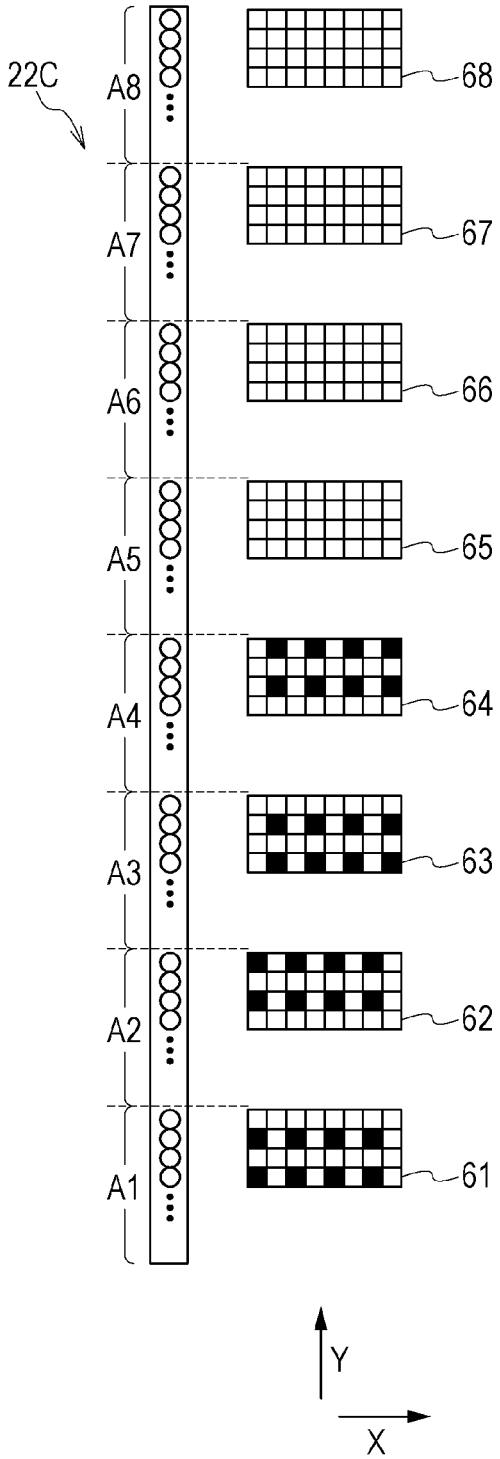
FIGS. 12A and 12B are schematic views showing mask patterns applied in an embodiment.
Figure 12B:
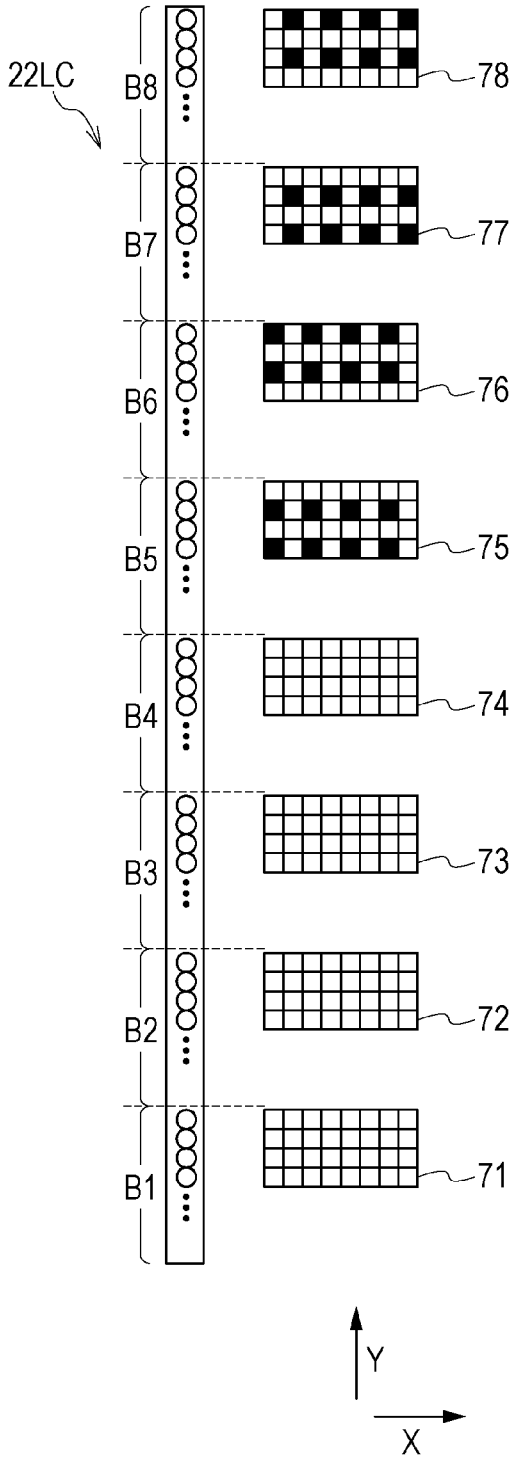

FIG. 12A shows mask patterns applied to the discharge port row 22C for discharging a cyan ink according to this embodiment. FIG. 12B shows mask patterns applied to the discharge port row 22LC for discharging a light cyan ink according to this embodiment.

Mask patterns 61 to 68 are applied to the recording groups A1 to A8 of the discharge port row 22C for discharging a cyan ink, respectively.

The mask patterns 61, 62, 63, and 64 corresponding to the four recording groups A1, A2, A3, and A4 each include print permitted pixels that account for 25% of all pixels. The print permitted pixels in the mask patterns 61, 62, 63, and 64 are arranged in different positions so that the logical sum of the print permitted pixels corresponds to all pixels.

On the other hand, the mask patterns 65, 66, 67, and 68 corresponding to the four recording groups A5, A6, A7, and A8 do not include print permitted pixels.

By applying such mask patterns, the cyan ink is discharged in an amount of 25% of all pixels in the unit region in each of the first to fourth print scanning operations and is not discharged in the fifth to eighth print scanning operations. Therefore, the cyan ink can be applied to all dischargeable positions in the unit region on the recording medium by the first to fourth print scanning operations.

Mask patterns 71 to 78 are applied to the recording groups B1 to B8 of the discharge port row 22LC for discharging a light cyan ink, respectively.

Unlike the recording groups of the discharge port row 22C for discharging a cyan ink, the mask patterns 71, 72, 73, and 74 corresponding to the four recording groups B1, B2, B3, and B4 do not include print permitted pixels.

The mask patterns 75, 76, 77, and 78 corresponding to the four recording groups B5, B6, B7, and B8 each include print permitted pixels that account for 25% of all pixels in the unit region. The print permitted pixels in the mask patterns 75, 76, 77, and 78 are arranged in different positions so that the logical sum of the print permitted pixels corresponds to all pixels. The mask pattern 75 has the same pattern as the mask pattern 61, the mask pattern 76 has the same pattern as the mask pattern 62, the mask pattern 77 has the same pattern as the mask pattern 63, and the mask pattern 78 has the same pattern as the mask pattern 64.

The print permitted pixels of the mask pattern applied to the recording group corresponding to each of the fifth to eighth print scanning operations for discharging a light cyan ink are arranged at the same positions as the print permitted pixels obtained by the logical summation of print permitted pixels of the mask patterns applied to the recording groups in the print scanning operations for discharging a cyan ink, the print scanning operations for discharging a cyan ink being performed prior to the print scanning operation for discharging a light cyan ink. Specifically, since the logical sum of the print permitted pixels of the mask patterns applied to the recording groups A1, A2, A3, and A4 corresponds to all pixels, the print permitted pixels of the mask patterns applied to the recording groups B5, B6, B7, and B8 are always arranged at the same positions as the print permitted pixels obtained from the logical sum.

Therefore, the light cyan ink is not discharged in the first to fourth print scanning operations and is discharged in an amount of 25% of all pixels in the unit region in each of the fifth to eighth print scanning operations. Consequently, the light cyan ink is always discharged at positions at which the cyan ink has been applied in the prior scanning operations. After the eighth print scanning operation, the light cyan ink is supposed to be discharged at all the positions (100%).

According to the configuration shown in FIGS. 12A and 12B, in the eight print scanning operations performed on the unit region on the recording medium, the cyan ink can be discharged in the first to fourth print scanning operations without discharging the light cyan ink and the light cyan ink can be discharged in the fifth to eighth print scanning operations without discharging the cyan ink.

Figure 13:
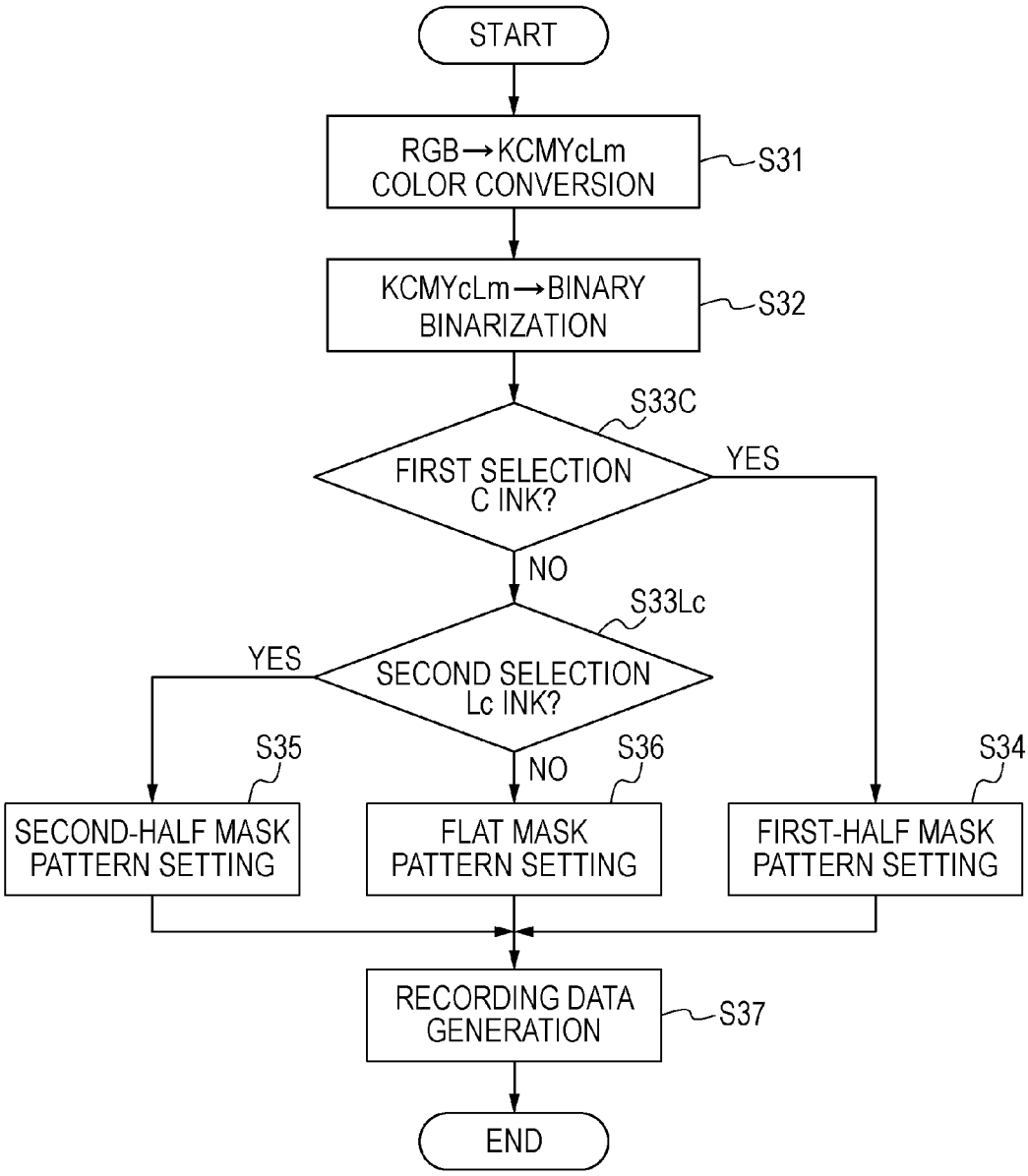
FIG. 13 is a flowchart for describing data processing in an embodiment.

FIG. 13 is a flowchart for describing an image processing process in the image processing unit according to this embodiment.

In a color conversion step S31, RGB multivalued data obtained from the host computer 301 serving as an image input unit is converted into multivalued data corresponding to each of colors of inks used for recording.

In a binarization step S32, the multivalued data corresponding to each of colors of inks and converted in the color conversion step S31 is rasterized into binary image data in accordance with stored patterns. This binarization generates pieces of binary data for discharging a black ink, a cyan ink, a magenta ink, a yellow ink, a light cyan ink, and a light magenta ink.

In a first selection step S33C, binary data for discharging a cyan ink is selected from the pieces of binary data generated in the binarization step S32 and corresponding to the inks. The selected binary image data for discharging a cyan ink is transmitted to a first-half mask pattern setting step S34 to set the above-described mask patterns.

In a second selection step S33LC, binary data for discharging a light cyan ink is selected from the pieces of binary image data that are not selected in the first selection step S33C, and is transmitted to a second-half mask pattern setting step S35. The above-described mask patterns are set to the transmitted data for discharging a light cyan ink in the second-half mask pattern setting step S35.

The pieces of binary image data that are used for discharging a black ink, a magenta ink, a yellow ink, and a light magenta ink and that are not selected in the first selection step S33C and the second selection step S33LC are transmitted to a flat mask pattern setting step S36. Flat mask patterns in which print permitted pixels are arranged at an equal ratio in each of eight print scanning operations are set to the binary image data.

In a recording data generating step S37, mask pattern processing is performed using the mask patterns set to the binary image data in the first-half mask pattern setting step S34, the second-half mask pattern setting step S35, and the flat mask pattern setting step S36. Thus, recording data allocated to a plurality of print scanning operations is generated for each of the inks.

Based on the thus-generated recording data, inks are discharged from the recording head 7 of the image recording apparatus 300 to form an image.

According to the above configuration, in any print scanning operation, a light cyan ink is discharged onto a surface of an ink layer formed of a cyan ink that has been fixed on a recording medium. Thus, recording can be performed while an ink film formed of a cyan ink by an acid-precipitation reaction is redissolved by a light cyan ink having a high pH buffer capacity in a basic region. Accordingly, an image having high scratch resistance can be recorded.

Second Embodiment

In the first embodiment, it has been described that the cyan ink is discharged only in the first-half print scanning operations among the plurality of print scanning operations and the light cyan ink is discharged only in the second-half print scanning operations.

In this embodiment, the cyan ink and the light cyan ink are simultaneously discharged in some of the plurality of print scanning operations. Note that the description of the same contents as in the first embodiment will be omitted.

Figure 14A:
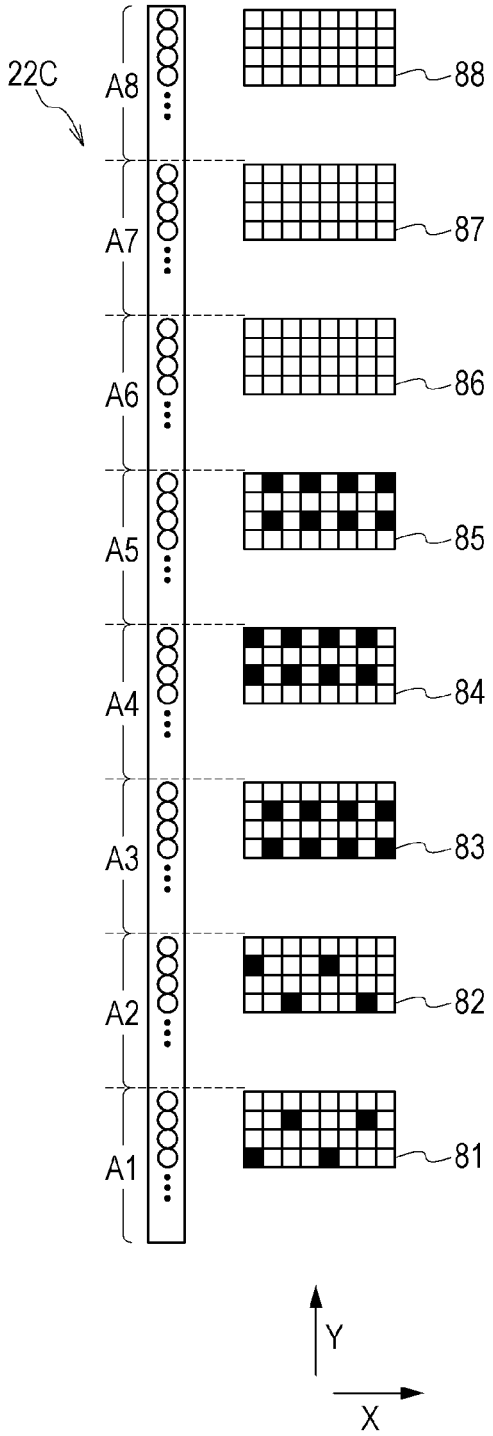
FIGS. 14A and 14B are schematic views showing mask patterns applied in an embodiment.
Figure 14B:
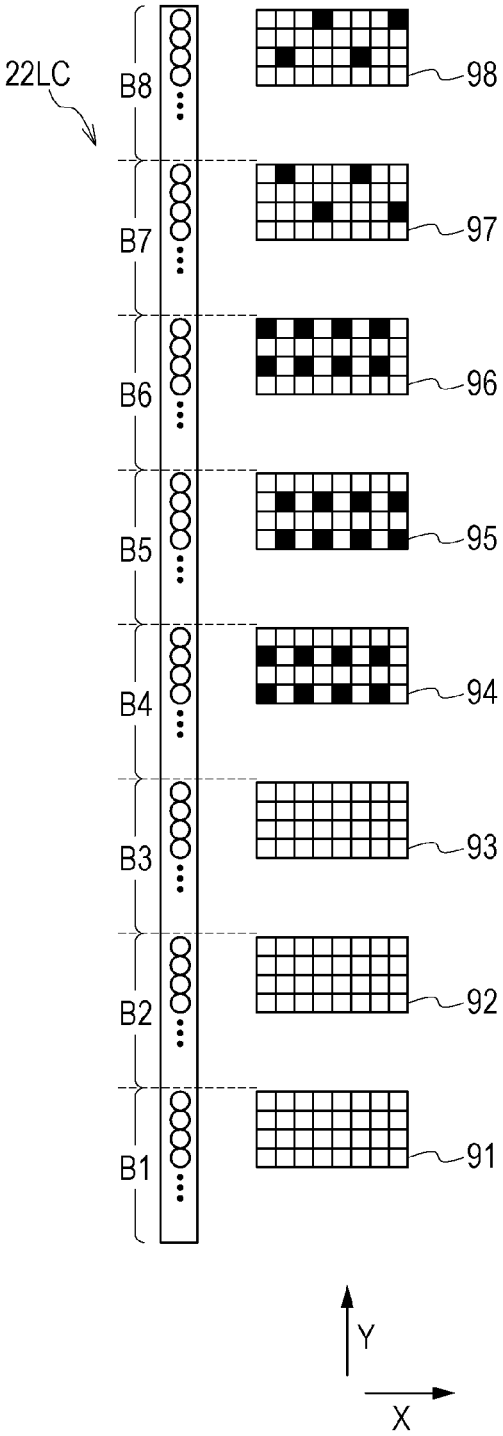

FIG. 14A shows mask patterns applied to the discharge port row 22C for discharging a cyan ink in this embodiment. FIG. 14B shows mask patterns applied to the discharge port row 22LC for discharging a light cyan ink in this embodiment.

In the discharge port row 22C for discharging a cyan ink, mask patterns 81 to 88 are respectively applied to a recording group A1 used for the first scanning operation to a recording group A8 used for the eighth scanning operation.

The print permitted pixels are arranged so that the mask patterns 81 and 82 have a print permission ratio of 12.5% and the mask patterns 83, 84, and 85 have a print permission ratio of 25%. The mask patterns 86, 87, and 88 do not include print permitted pixels.

The print permitted pixels in the mask patterns 81 to 85 are arranged in different positions so that the logical sum of the print permitted pixels corresponds to all pixels.

In the discharge port row 22LC for discharging a light cyan ink, mask patterns 91 to 98 are respectively applied to a recording group B1 to a recording group B8.

The print permitted pixels are arranged so that the mask patterns 94, 95, and 96 have a print permission ratio of 25% and the mask patterns 97 and 98 have a print permission ratio of 12.5%. The mask patterns 91, 92, and 93 do not include print permitted pixels.

The mask pattern 83 and the mask pattern 95 include print permitted pixels arranged at the same positions. The mask pattern 84 and the mask pattern 96 include print permitted pixels arranged at the same positions. The logical sum of the print permitted pixels arranged in the mask patterns 81 and 82 corresponds to the print permitted pixels arranged in the mask pattern 94. Similarly, the logical sum of the print permitted pixels arranged in the mask patterns 97 and 98 corresponds to the print permitted pixels arranged in the mask pattern 85.

Also in this embodiment, the print permitted pixels of the mask pattern applied to the recording group corresponding to each of the fourth to eighth print scanning operations for discharging a light cyan ink are arranged at the same positions as the print permitted pixels obtained by the logical summation of the print permitted pixels of the mask patterns applied to the recording groups in the print scanning operations for discharging a cyan ink, the print scanning operations for discharging a cyan ink being performed prior to the print scanning operation for discharging a light cyan ink. For example, the print permitted pixels of the mask pattern 94 applied to the recording group B4 in the fourth print scanning operation for discharging a light cyan ink are arranged at the same positions as the print permitted pixels obtained by the logical summation of the print permitted pixels of the mask patterns 81 and 82 applied to the recording groups A1 and A2 in the first and second print scanning operations for discharging a cyan ink. In other words, all print permitted pixels of the mask pattern 94 in the fourth print scanning operation for discharging a light cyan ink are included in the print permitted pixels obtained by the logical summation of the print permitted pixels of the mask patterns 81, 82, and 83 in the first to third print scanning operations for discharging a cyan ink.

Therefore, a light cyan ink is not discharged, but a cyan ink is discharged in the first, second, and third print scanning operations. In the fourth print scanning operation, a light cyan ink is discharged at positions on the recording medium to which the cyan ink has been applied in the first and second print scanning operations. In the fifth print scanning operation, a light cyan ink is discharged onto a region to which the cyan ink has been applied in the third print scanning operation. The discharge of the cyan ink onto all pixels is completed by the first to fifth print scanning operations. In the sixth, seventh, and eighth print scanning operations, the cyan ink is not discharged and the light cyan ink is discharged at positions on the recording medium to which the cyan ink has been applied.

According to the above configuration, even if print scanning operations for simultaneously discharging a light cyan ink and a cyan ink are performed, the cyan ink and the light cyan ink can be applied to all pixels on the recording medium in that order as in the first embodiment. Thus, the degradation of image quality can be suppressed.

Furthermore, since the number of print scanning operations for discharging the cyan ink and the light cyan ink increases compared with the first embodiment, an effect achieved by the multipass recording method can be suitably produced.

The amount of ink discharged from the recording groups A1 and B8 located at the end of the discharge port row can be decreased. This can suppress the impact position deviation of ink droplets discharged from discharge ports at the end that are easily affected by air flow generated as a result of ink discharge.

It has been described in the first and second embodiments that an ink having a relatively high pH buffer capacity in a basic region is discharged onto all the unit regions on the recording medium after the discharge of an ink having a relatively low pH buffer capacity in a basic region. However, the ink having a relatively high pH buffer capacity in a basic region is not necessarily discharged onto all the unit regions after the discharge of the ink having a relatively low pH buffer capacity in a basic region. A sufficient effect is believed to be produced at least when the number of regions on the recording medium where the ink having a relatively high pH buffer capacity in a basic region is discharged later is larger than the number of regions on the recording medium where the ink having a relatively low pH buffer capacity in a basic region is discharged later.

The area of dots formed on the recording medium by discharging a second ink and a first ink in that order may be larger than the area of dots formed on the recording medium by discharging the first ink and the second ink in that order.

It has been described in the first and second embodiments that a recording head including first and second discharge port rows arranged at the same position in a Y direction is used, and a predetermined number of discharge ports in one end portion (upstream side) of the first discharge port row and a predetermined number of discharge ports in one end portion (downstream side) of the second discharge port row are not used. However, in addition to such embodiments, other embodiments in which the ink discharge order can be controlled can be employed. For example, all discharge ports of first and second discharge port rows may be used by using a recording head including the first and second discharge port rows arranged so as to be shifted in the Y direction.

Third Embodiment

It has been described in the first and second embodiments that attention is paid to only the cyan ink and light cyan ink among the plurality of inks, and the discharge order of the cyan ink and light cyan are determined in accordance with the level of the pH buffer capacities of the two inks in a basic region.

In this embodiment, the discharge order of inks is determined in consideration of the level of the pH buffer capacities of all the inks in a basic region. The description of the same contents as in the first and second embodiments will be omitted.

Figure 15:
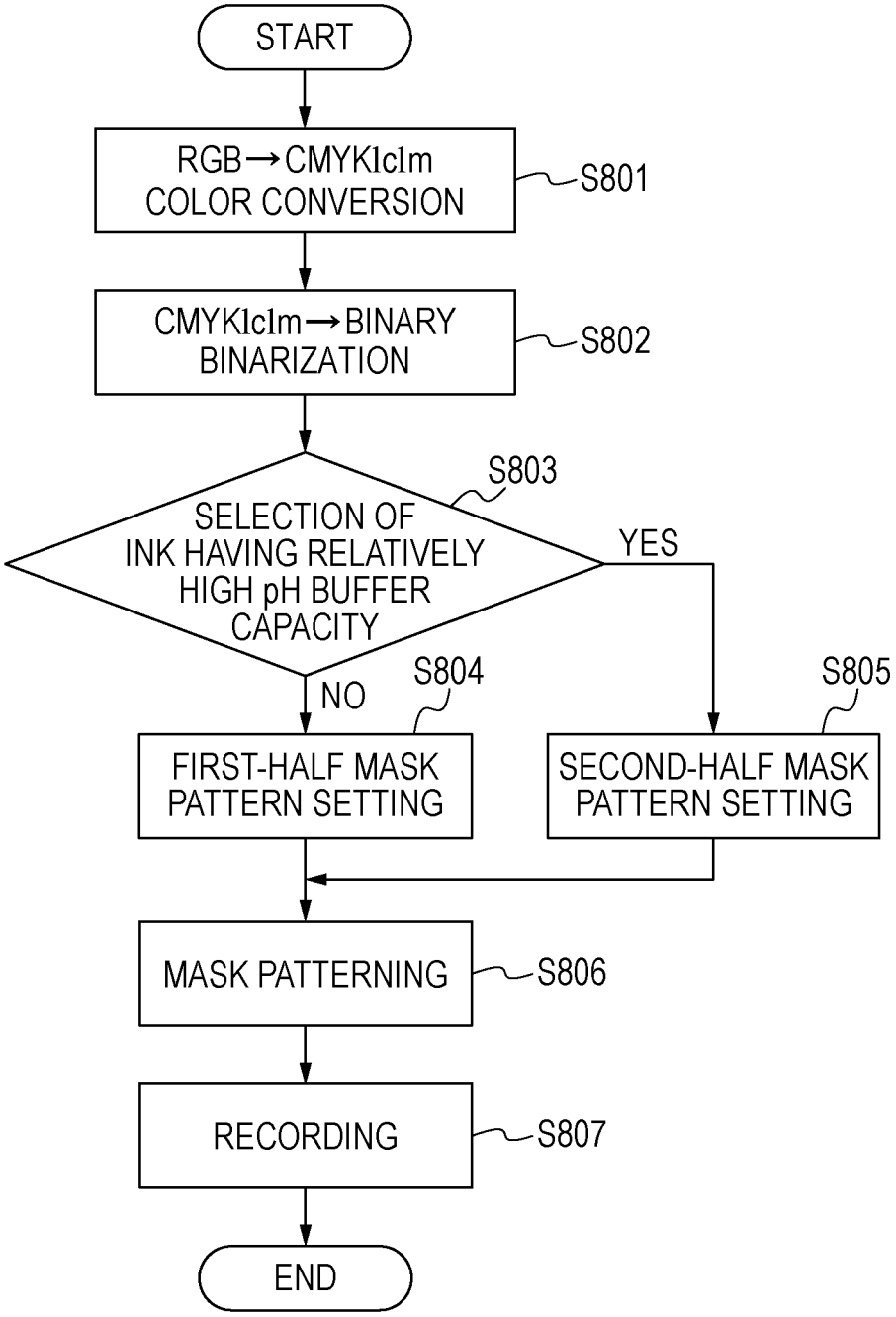
FIG. 15 is a flowchart for describing data processing in an embodiment.

FIG. 15 is a flowchart for describing an image processing process in an image processing unit according to this embodiment. In this embodiment, all inks are classified into inks having a relatively high pH buffer capacity in a basic region and inks having a relatively low pH buffer capacity in a basic region in a step S803. Furthermore, second-half mask patterns are set to the inks having a relatively low pH buffer capacity in a basic region in a step S805 and first-half mask patterns are set to the inks having a relatively high pH buffer capacity in a basic region in a step S804, and then recording is performed.

The classification into the inks having a relatively high pH buffer capacity and the inks having a relatively low pH buffer capacity can be appropriately made. For example, the classification may be made by comparing the amount of an aqueous hydrochloric acid solution added dropwise to each ink until the pH reaches 7 with a predetermined threshold stored in a ROM in advance. Alternatively, the classification may be made by determining, at a predetermined ratio, inks in which the amount of an aqueous hydrochloric acid solution added dropwise until the pH reaches 7 is relatively large and inks in which the amount is relatively small. In this embodiment, it is determined from Table 1 that a light cyan ink and a light magenta ink are inks having a relatively high pH buffer capacity and a cyan ink, a magenta ink, a yellow ink, and a black ink are inks having a relatively low pH buffer capacity. The mask patterns shown in FIGS. 12A and 12B are used as the first-half mask patterns and the second-half mask patterns, respectively.

According to this embodiment, after all the inks having a relatively low pH buffer capacity in a basic region among the plurality of inks are applied, the inks having a relatively high pH buffer capacity in a basic region can be applied. Thus, the scratch resistance can be further improved.

It has been described in the third embodiment that a plurality of inks are classified into two groups in accordance with the level of pH buffer capacity, and first-half mask patterns and second-half mask patterns are appropriately set to the inks. However, this embodiment is not limited to only the classification into two groups, and the number of groups may be appropriately determined. In such a case, the discharge may also be sequentially performed in groups.

Fourth Embodiment

It has been described in the first to third embodiments that an ink having a pH buffer capacity in a basic region by adding triethanolamine is used. In this embodiment, an ink having a pH buffer capacity in a basic region by adding sodium carbonate instead of triethanolamine is used. The description of the same contents as in the first and second embodiments will be omitted.

Ink Composition

The composition of inks used in this embodiment will be described. In this embodiment, four colors of inks, namely a cyan ink, a magenta ink, a yellow ink, and a black ink are used. The preparation of a dispersion liquid for each ink and the method for preparing each ink are the same as those of the cyan ink, magenta ink, yellow ink, and black ink of the first embodiment, except for components added to the inks. A distinctive additive added to the inks in this embodiment is sodium carbonate, which is a weakly basic substance. Table 3 shows the composition of inks in this embodiment.

TABLE 3

| | Ink composition | Cyan | Magenta | Yellow | Black |
|---|---|---|---|---|---|
| Pigment | Cyan dispersion liquid | 20 parts | | | |
| | Magenta dispersion liquid | | 40 parts | | |
| | Yellow dispersion liquid | | | 40 parts | |
| | Black dispersion liquid | | | | 50 parts |
| Surfactant | Zonyl FSO-100 | 0.05 parts | 0.05 parts | 0.25 parts | 0.05 parts |
| | Acetylene glycol EO adduct | 0.5 parts | 0.5 parts | 1.0 part | 0.5 parts |
| Humectant | Glycerol | 10 parts | 10 parts | 9 parts | 10 parts |
| | Ethylene glycol | | | 10 parts | |
| | Diethylene glycol | 10 parts | 10 parts | | |
| | Triethylene glycol | | | | 10 parts |
| Dispersion stabilizer | Sodium carbonate | | | 0.5 parts | |
| Water | Ion exchanged water | Balance | Balance | Balance | Balance |
| Total | | 100 parts | 100 parts | 100 parts | 100 parts |

TABLE 4

| Ink | Amount of 1N aqueous hydrochloric acid solution (ml) |
|---|---|
| Cyan (C) ink | 0.2 |
| Magenta (M) ink | 0.3 |
| Yellow (Y) ink | 2.1 |
| Black (K) ink | 0.3 |

As is clear from Table 4, the amount of an aqueous hydrochloric acid solution added dropwise to the yellow ink until the pH reaches 7 is 2.1 ml whereas the amounts of an aqueous hydrochloric acid solution added dropwise to other inks until the pH reaches 7 are 0.2 to 0.3 ml, which are smaller than the amount in the case of the yellow ink. Therefore, the yellow ink to which sodium carbonate is added has a relatively high pH buffer capacity in a basic region and the cyan ink, the magenta ink, and the black ink to which sodium carbonate is not added have a relatively low pH buffer capacity in a basic region. Thus, among the inks used in this embodiment, the yellow ink is classified into an ink group having a relatively high pH buffer capacity in an alkaline region and the cyan ink, the magenta ink, and the black ink are classified into an ink group having a relatively low pH buffer capacity in an alkaline region.

Accordingly, the same processing as in the third embodiment is performed, second-half mask patterns are set to the yellow ink and first-half mask patterns are set to each of the cyan ink, the magenta ink, and the black ink, and then recording is performed.

According to this embodiment, even when a difference in the pH buffer capacity in a basic region is made by differentiating the amounts of sodium carbonate added, the degradation of scratch resistance can be suppressed.

Fifth Embodiment

In the first to fourth embodiments, there has been described a method for controlling the discharge order of a plurality of inks in a so-called multipass recording apparatus with which recording is performed on a unit region on a recording medium by a plurality of print scanning operations.

In this embodiment, the discharge order of a plurality of inks is controlled in a recording apparatus which includes a plurality of recording heads corresponding to the inks and having a length sufficiently larger than the width of a recording medium and with which recording is performed by relatively performing a single print scanning operation between the recording heads and the recording medium. Note that the description of the same contents as in the first embodiment will be omitted.

Figure 16:
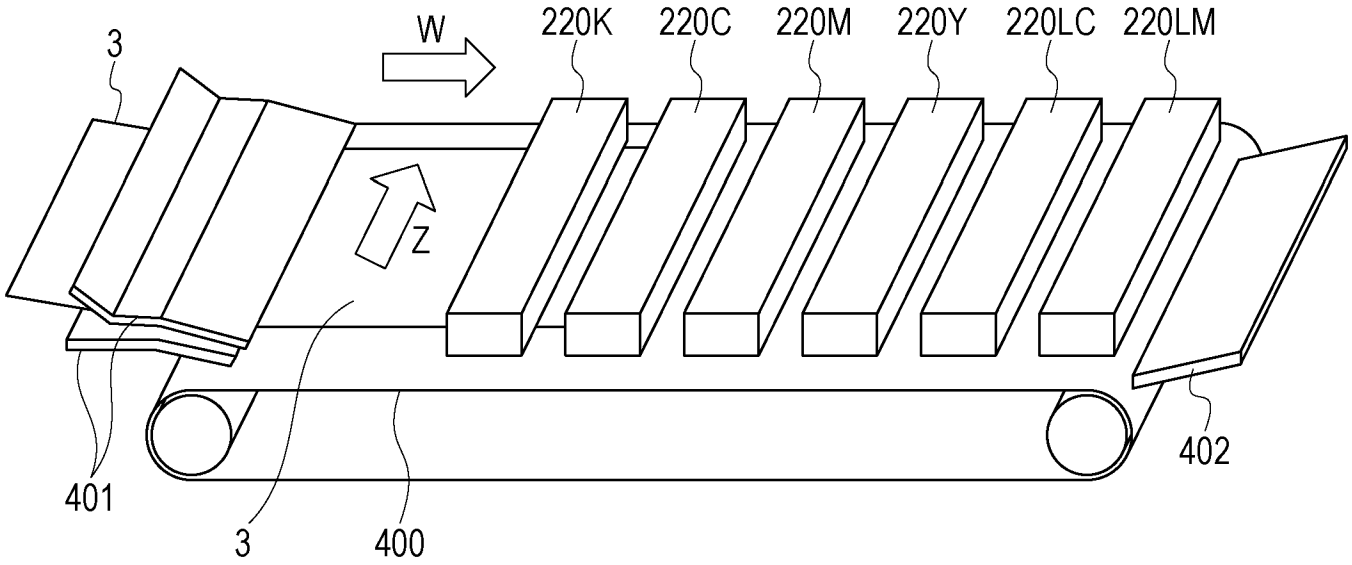
FIG. 16 is a perspective view showing an image recording apparatus applied in an embodiment.

FIG. 16 is a partial side view showing an internal structure of a recording apparatus according to this embodiment. Six recording heads 220C, 220M, 220Y, 220K, 220LC, and 220LM for respectively discharging a cyan ink, a magenta ink, a yellow ink, a black ink, a light cyan ink, and a light magenta ink each include a predetermined number of discharge ports (not shown) arranged in a Z direction. The length of each discharge port row in the Z direction is larger than or equal to the length of the recording medium 3 in the Z direction so that recording can be performed in the entire region of the recording medium 3 in the Z direction.

A conveyance belt 400 conveys the recording medium 3. The conveyance belt 400 is rotated in a W direction intersecting the Z direction by a feeding unit 401 and an ejecting unit 402.

The recording medium 3 is fed by the feeding unit 401 and conveyed in the W direction by the conveyance belt 400.

In this embodiment, the recording head 220K, the recording head 220C, the recording head 220M, the recording head 220Y, the recording head 220LC, and the recording head 220LM are sequentially arranged from the upstream side in the W direction.

Therefore, after the black ink, the cyan ink, the magenta ink, and the yellow ink each having a relatively low pH buffer capacity in a basic region are applied to a unit region on the recording medium, the light cyan ink and the light magenta ink each having a relatively high pH buffer capacity in a basic region can be applied.

According to the above configuration, even when a recording apparatus with which recording is performed on a unit region on the recording medium by a single print scanning operation is employed, a desired discharge order can be provided in accordance with the level of the pH buffer capacity in a basic region. Consequently, the scratch resistance of images can be improved.

Furthermore, since an image can be completely formed by a single print scanning operation, the recording time can be shortened.

The length of the discharge port row in the Z direction in this embodiment corresponds to the width of the recording medium. However, a so-called joint head whose length is increased by arranging a plurality of short discharge port rows in the Z direction may also be used as the recording head.

It has been described in this embodiment that a plurality of inks are classified into two groups in accordance with the level of the pH buffer capacity in a basic region, and recording heads for discharging inks that belong to a group having a relatively low pH buffer capacity are disposed on the upstream side in the W direction and recording heads for discharging inks that belong to a group having a relatively high pH buffer capacity are disposed on the downstream side in the W direction. However, this embodiment is not limited to such a structure. For example, recording heads may be disposed from the upstream side in the W direction in the order from a recording head for discharging an ink having a low pH buffer capacity to a recording head for discharging an ink having a high pH buffer capacity.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiments of the present invention, and by a method performed by the computer of the system or apparatus by, for example, reading out and executing the computer executable instructions from the storage medium to perform the functions of one or more of the above-described embodiments. The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

It has been described in the above embodiments that an ink film formed by an acid-precipitation reaction is redissolved using a pH buffer capacity in a basic region, which is generated by adding triethanolamine or sodium carbonate. However, the present invention is not limited to an embodiment in which an ink containing triethanolamine or sodium carbonate is used. Any ink having a pH buffer capacity in a basic region by adding a pH buffering agent may be used. Examples of the pH buffering agent that can be suitably used include salts of ammoniums, organic amines, and amino acids. Specific examples of the pH buffering agent include salts of amino acids such as glycine, alanine, aspartic acid, glutamic acid, phenylalanine, leucine, isoleucine, and lysine; and salts of organic amines such as diethanolamine, monoethanolamine, diisopropanolamine, and triisopropanolamine. In particular, ammonium salts can be used because of their high solubility in water. Examples of the ammonium salts include ammonium salts of polyphosphoric acid, dicarboxylic acid, polyaminocarboxylic acid, aldonic acid, and hydroxycarboxylic acid, ammonium sulfate, ammonium nitrate, and ammonium hydrochloride. In particular, ammonium salts of polyphosphoric acids such as pyrophosphoric acid, tripolyphosphoric acid, and hexametaphosphoric acid; ammonium salts of dicarboxylic acids such as oxalic acid, malonic acid, succinic acid, and glutaric acid; ammonium salts of polyaminocarboxylic acids such as ethylenediaminetetraacetic acid, iminodiacetic acid, and nitrilotriacetic acid; ammonium salts of aldonic acids such as glycolic acid, glyceric acid, gluconic acid, galactonic acid, and glucoheptonic acid; ammonium salts of hydroxycarboxylic acids such as citric acid, malic acid, lactic acid, glycolic acid, glyceric acid, mandelic acid, and tartaric acid can be used to also prevent kogation. Among them, ammonium salts of citric acid and gluconic acid can be particularly used in terms of kogation-preventing effects and high solubility.

It has been described in the above embodiments that an acid-precipitation reaction of a dispersion polymer in an ink is caused because the pH of a paper surface of a recording medium is lower than that of an ink, but other embodiments may be employed. For example, the acid-precipitation reaction of a dispersion polymer is caused even when a reaction liquid is applied prior to the application of an ink and the pH of a surface of a reaction liquid layer fixed on a recording medium is lower than that of an ink, and the suppression can be achieved by controlling the ink discharge order according to each of the above embodiments.

Figure 1A:
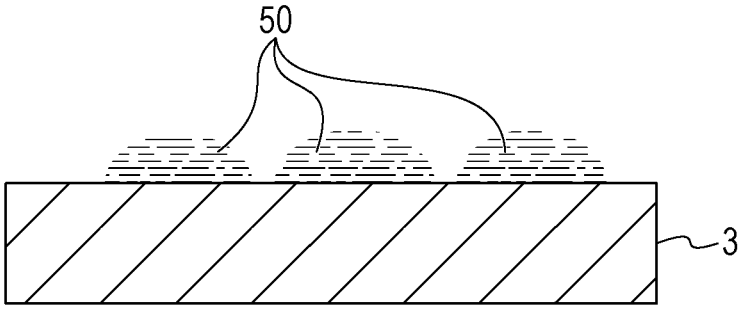
FIGS. 1A to 1C are diagrams for describing formation of an ink film due to an acid-precipitation reaction.
Figure 1B:
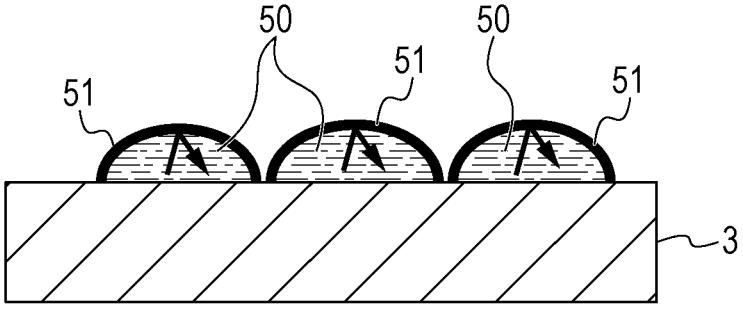
Figure 1C:
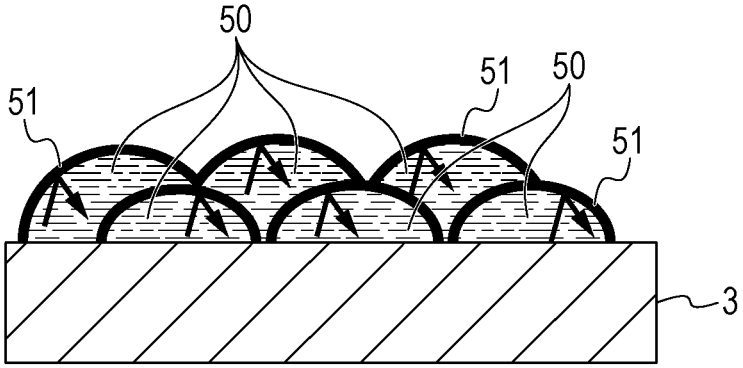

It has been described in the above embodiments that the ink discharge order is controlled in accordance with the level of a pH buffer capacity in a basic region, but other embodiments may be employed. An embodiment in which the ink discharge order is controlled by another factor will be described below. It has been described that, when an ink film is formed by the acid-precipitation reaction as shown in FIG. 1B, an $OH^-$ group facilitates the redissolution of the ink film. That is, since the redissolution reaction of the ink film occurs when the amount of an $OH^-$ group supplied is large, the redissolution of the ink film formed by the acid-precipitation reaction can be achieved by controlling the ink discharge order even when a strongly basic ink is used. Therefore, in the following embodiment, the ink discharge order is controlled so that the number of regions on a recording medium in which a weakly basic ink and a strongly basic ink are discharged in that order is larger than the number of regions on a recording medium in which a strongly basic ink and a weakly basic ink are discharged in that order. Thus, the strongly basic ink applied onto a surface of a lower layer composed of the weakly basic ink facilitates the redissolution of the ink film formed on the lower layer. Consequently, the same advantageous effects as in the above embodiments are produced.

In the present invention, color inks are used, but inks are not necessarily colored. For example, the present invention can also be applied to colorless inks containing no coloring materials.

In the embodiments described above, coated paper having low ink absorbency is used as the recording medium. However, the recording medium is not limited to low-absorbing media. Advantageous effects can also be produced with non-absorbing media such as a vinyl chloride medium.

In the first to fourth embodiments, binary data is allocated to each scanning operation using mask patterns. However, the present invention can be sufficiently applied as long as a method capable of performing recording on each pixel is employed, and the method is not limited to that using the mask patterns. For example, recording data may be sequentially allocated to a plurality of buffers corresponding to a plurality of print scanning operations for each pixel by an allocation circuit disposed in an image recording apparatus to determine which print scanning operation is used to record a particular pixel. In the allocation circuit, it can be controlled that ink is discharged onto a particular pixel in a particular scanning operation.

In an image recording apparatus according to an embodiment of the present invention, there can be provided a recording apparatus that can produce a recorded article having excellent scratch resistance when recording is performed with an ink containing a pigment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-136149, filed Jun. 28, 2013, which is hereby incorporated by reference herein in its entirety.

What is claimed is:

1. An image recording apparatus comprising:

a recording head configured to discharge at least a first-color ink comprising a pigment and a second-color ink comprising a pigment;

a scanning unit configured to cause relative scanning between the recording head and a recording medium in a scanning direction, the recording medium having a unit region including a plurality of pixel regions each corresponding to each of a plurality of pixels; and a control unit configured to control discharge of the first-color ink and the second-color ink from the recording head onto the pixel regions while the scanning is caused by the scanning unit, wherein the second-color ink has a higher pH buffer capacity in a basic region than the first-color ink, and the control unit is configured to control the discharge of the first-color ink and the second-color ink so that in the unit region, among the pixel regions to which both the first-color ink and the second-color ink are applied, the number of pixel regions to which the second-color ink is applied after the first-color ink is applied is larger than the number of pixel regions to which the first-color ink is applied after the second-color ink is applied.

2. The image recording apparatus according to claim 1, wherein the scanning unit is configured to cause the print head to scan the unit region a plurality of times, and the control unit is configured to control the discharge of the first-color ink and the second-color ink so that in the unit region, among the pixel regions to which both the first-color ink and the second-color ink are applied, the number of pixel regions to which the second-color ink is applied through the scanning performed after the first-color ink is applied is larger than the number of pixel regions to which the first-color ink is applied through the scanning performed after the second-color ink is applied.

3. The image recording apparatus according to claim 1, wherein the control unit is configured to control the discharge of the first-color ink and the second-color ink so that, to the unit region, the second-color ink is applied after the first-color ink is applied onto all pixel regions to which both the first-color ink and the second-color ink are applied.

4. The image recording apparatus according to claim 3, wherein the scanning unit is configured to cause the print head to scan the unit region a plurality of times, and the control unit is configured to control the discharge of the first-color ink and the second-color ink so that, in the unit region located on the recording medium, the second-color ink is applied through the scanning performed after the first-color ink is applied onto all pixel regions to which both the first-color ink and the second-color ink are applied.

5. The image recording apparatus according to claim 1, wherein the first-color ink and the second-color ink each have a pH of 8.5 or more and 9.5 or less.

6. The image recording apparatus according to claim 1, wherein a change in pH caused when 1 ml of a 1 N aqueous hydrochloric acid solution is added to 50 ml of the second-color ink is 1.5 or less.

7. The image recording apparatus according to claim 6, wherein the change in pH caused when 1 ml of a 1 N aqueous hydrochloric acid solution is added to 50 ml of the second-color ink is 1.0 or less.

8. The image recording apparatus according to claim 1, wherein the first-color ink and the second-color ink each comprise an organic amine.

9. The image recording apparatus according to claim 8, wherein the organic amine is triethanolamine.

10. The image recording apparatus according to claim 1, wherein the first-color ink and the second-color ink each comprise a coloring material dispersed or dissolved by an anionic group.

11. The image recording apparatus according to claim 1, wherein the recording head is configured to further discharge a third-color ink comprising a pigment and having a higher pH buffer capacity in a basic region than the second-color ink, and the control unit is configured to control the discharge of the second-color ink and the third-color ink so that in the unit region, among pixel regions to which both the second-color ink and the third-color ink are applied, the number of pixel regions to which the third-color ink is applied after the second-color ink is applied is larger than the number of pixel regions to which the second-color ink is applied after the third-color ink is applied.

12. The image recording apparatus according to claim 1, further comprising:

a conveyance unit configured to convey the recording medium from an upstream side to a downstream side in a conveying direction intersecting the scanning direction at a timing between a particular operation of the scanning of the recording head and a next scanning operation performed after the particular operation of the scanning, wherein the recording head comprises a first discharge port row in which a plurality of discharge ports for discharging the first-color ink are arranged and a second discharge port row in which a plurality of discharge ports for discharging the second-color ink are arranged, and the second discharge port row is disposed at a position that is different from a position of the first discharge port row in the scanning direction and that is shifted to the downstream side.

13. The image recording apparatus according to claim 1, further comprising:

a conveyance unit configured to convey the recording medium from an upstream side to a downstream side in a conveying direction intersecting the scanning direction at a timing between a particular operation of the scanning of the recording head and a next scanning operation performed after the particular operation of the scanning, wherein the recording head comprises a first discharge port row in which a plurality of discharge ports for discharging the first-color ink are arranged and a second discharge port row in which a plurality of discharge ports for discharging the second-color ink are arranged, the first discharge port row and the second discharge port row are disposed at positions that are different from each other in the scanning direction and at positions that are substantially the same as each other in the conveying direction, and a particular number of discharge ports arranged in an end portion of the first discharge port row on the downstream side and a particular number of discharge ports arranged in an end portion of the second discharge port row on the upstream side are not used for recording.

14. The image recording apparatus according to claim 13, wherein the control unit is configured to control the discharge of the first-color ink and the second-color ink by applying a plurality of mask patterns to image data, each mask pattern including print permitted pixels and print forbidden pixels, and the plurality of mask patterns comprise a second mask pattern used for a particular number of discharge ports of the second discharge port row in a particular operation of the scanning and a first mask pattern used for a particular number of discharge ports of the first discharge port row in a scanning operation performed after the particular scanning operation, and positions of the print permitted pixels in the second mask pattern are the same as positions of the print permitted pixels in the first mask pattern.

15. The image recording apparatus according to claim 1, wherein the recording medium is a recording medium having a transferred ink amount per second of 20 $ml \cdot m^{-2}$ or less for the first-color ink and the second-color ink, the transferred ink amount being measured by a Bristow test.

16. The image recording apparatus according to claim 1, wherein a pH of a paper surface of the recording medium is lower than a pH of the first-color ink.

17. An image recording apparatus comprising:

a recording head configured to discharge a plurality of color inks each comprising a pigment;

a scanning unit configured to cause relative scanning between the recording head and a recording medium in a scanning direction, the recording medium having a unit region including a plurality of pixel regions each corresponding to each of a plurality of pixels; and a control unit configured to control discharge of the plurality of color inks from the recording head onto the pixel regions while the scanning is caused by the scanning unit, wherein the plurality of color inks are classified into a first ink group and a second ink group that comprises inks having a higher pH buffer capacity in a basic region than inks which belong to the first ink group, and the control unit is configured to control the discharge of the plurality of color inks so that in the unit region, among the pixel regions to which both the inks which belong to the first ink group and the inks which belong to the second ink group are applied, the number of pixel regions to which the inks which belong to the second ink group are applied after the inks which belong to the first ink group are applied is larger than the number of pixel regions to which the inks which belong to the first ink group are applied after the inks which belong to the second ink group are applied.

18. An image recording apparatus comprising:

a recording head configured to discharge at least a first-color ink comprising a pigment and a second-color ink comprising a pigment and having a higher pH than the first-color ink;

a scanning unit configured to cause relative scanning between the recording head and a recording medium in a scanning direction, the recording medium having a unit region including a plurality of pixel regions each corresponding to each of a plurality of pixels; and a control unit configured to control discharge of the first-color ink and the second-color ink from the recording head onto the pixel regions while the scanning is caused by the scanning unit, wherein the control unit is configured to control the discharge of the first-color ink and the second-color ink so that in the unit region, among the pixel regions to which both the first-color ink and the second-color ink are applied, the number of pixel regions to which the second-color ink is applied after the first-color ink is applied is larger than the number of pixel regions to which the first-color ink is applied after the second-color ink is applied.

19. An image processing apparatus configured to generate recording data for determining ink discharge, the recording data being set for each of pixel regions each corresponding to each of a plurality of pixels included in a unit region, while a plurality of relative scanning operations of a recording head configured to discharge at least a first-color ink comprising a pigment and a second-color ink comprising a pigment are performed over the unit region on a recording medium in a scanning direction, the image processing apparatus comprising:

an acquisition unit configured to acquire first binary data corresponding to an image of the first-color ink to be recorded in the unit region through the plurality of scanning operations by determining discharge or non-discharge of the first-color ink onto each of the pixel regions in the unit region and second binary data corresponding to an image of the second-color ink to be recorded in the unit region through the plurality of scanning operations by determining discharge or non-discharge of the second-color ink onto each of the pixel regions in the unit region; and a generation unit comprising a plurality of first and second mask patterns that each comprise print permitted pixels and print forbidden pixels and correspond to the plurality of scanning operations, the generation unit being configured to generate a plurality of pieces of the recording data corresponding to the plurality of scanning operations from the first binary data and the second binary data on a basis of the first and second mask patterns, wherein the second-color ink has a higher pH buffer capacity in a basic region than the first-color ink, the plurality of scanning operations comprise a particular scanning operation of discharging at least the second-color ink, one second mask pattern used in the particular scanning operation comprises print permitted pixels arranged at the same positions as print permitted pixels obtained by logical summation of print permitted pixels arranged in the first mask patterns used in scanning operations performed before the particular scanning operation, one first mask pattern used in the particular scanning operation comprises print permitted pixels arranged at the same positions as print permitted pixels obtained by logical summation of print permitted pixels arranged in the second mask patterns used in scanning operations performed before the particular scanning operation, and the first and second mask patterns comprise print permitted pixels arranged in such a manner that the number of print permitted pixels in the one second mask pattern is larger than the number of print permitted pixels in the one first mask pattern.

20. The image processing apparatus according to claim 19, wherein the first-color ink and the second-color ink each have a pH of 8.5 or more and 9.5 or less.

21. The image processing apparatus according to claim 19, wherein a change in pH caused when 1 ml of a 1 N aqueous hydrochloric acid solution is added to 50 ml of the second-color ink is 1.5 or less.

22. The image processing apparatus according to claim 19, wherein the first-color ink and the second-color ink each comprise an organic amine.

23. A storage medium storing a program, wherein a computer that reads the program serves as the image processing apparatus according to claim 1.

24. An image recording method comprising discharging a first-color ink comprising a pigment and a second-color ink comprising a pigment from a recording head configured to discharge at least the first-color ink and the second-color ink onto pixel regions each corresponding to each of a plurality of pixels included in a unit region on a recording medium while the recording head is caused to relatively scan over the recording medium in a scanning direction, wherein the second-color ink has a higher pH buffer capacity in a basic region than the first-color ink, and the first-color ink and the second-color ink are discharged so that in the unit region, among the pixel regions to which both the first-color ink and the second-color ink are applied, the number of pixel regions to which the second-color ink is applied after the first-color ink is applied is larger than the number of pixel regions to which the first-color ink is applied after the second-color ink is applied.

* * * * *